US008126167B2

(12) United States Patent
Hirade et al.

(10) Patent No.: US 8,126,167 B2
(45) Date of Patent: Feb. 28, 2012

(54) CONDENSER MICROPHONE

(75) Inventors: Seiji Hirade, Shizuoka-Ken (JP); Tamito Suzuki, Shizuoka-Ken (JP); Yukitoshi Suzuki, Shizuoka-Ken (JP); Masayoshi Omura, Hamamatsu (JP); Yuusaku Ebihara, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 1214 days.

(21) Appl. No.: 11/691,943

(22) Filed: Mar. 27, 2007

(65) Prior Publication Data

US 2007/0286438 A1 Dec. 13, 2007

(30) Foreign Application Priority Data

| | | |
|---|---|---|
| Mar. 29, 2006 | (JP) | 2006-092039 |
| Mar. 29, 2006 | (JP) | 2006-092063 |
| Mar. 29, 2006 | (JP) | 2006-092076 |
| Oct. 12, 2006 | (JP) | 2006-278246 |
| Oct. 16, 2006 | (JP) | 2006-281902 |

(51) Int. Cl.
*H04R 25/00* (2006.01)

(52) U.S. Cl. ..... 381/174; 381/191

(58) Field of Classification Search ..... 381/113, 381/116, 173–175, 190, 191, 369; 367/140, 367/181, 170; 29/594, 25.41, 25.42
See application file for complete search history.

(56) References Cited

U.S. PATENT DOCUMENTS

| | | | | |
|---|---|---|---|---|
| 4,776,019 | A | 10/1988 | Miyatake et al. | |
| 6,535,460 | B2 * | 3/2003 | Loeppert et al. | 367/181 |

FOREIGN PATENT DOCUMENTS

| | | | |
|---|---|---|---|
| JP | 6-217397 | | 8/1994 |
| JP | 9-508777 | | 9/1997 |
| JP | 2004-506394 | | 2/2004 |
| KR | 10-20050088208 | A | 9/2005 |
| TW | 240589 | B | 9/2005 |
| WO | WO-03/045110 | A1 | 5/2003 |

* cited by examiner

*Primary Examiner* — Curtis Kuntz
*Assistant Examiner* — Sunita Joshi
(74) *Attorney, Agent, or Firm* — Dickstein Shapiro LLP

(57) ABSTRACT

The present invention provides a condenser microphone, in which, with a simple manufacturing process, vibration characteristics of a diaphragm are improved, and a parasitic capacitance occurring between the diaphragm and a back plate is reduced, thus improving sensitivity. Specifically, the diaphragm having a gear-like shape including a center portion and a plurality of arms and the back plate having a gear-like shape including a center portion and a plurality of arms are positioned opposite to each other above a substrate, wherein the arms of the diaphragm and the arms of the back plate are not positioned opposite to each other. Alternatively, it is possible to independently support the diaphragm and the back plate above the substrate. Furthermore, it is possible to support the back plate above the substrate by means of a plurality of supports inserted into a plurality of holes formed in the center portion of the diaphragm.

22 Claims, 19 Drawing Sheets

FIG. 1A
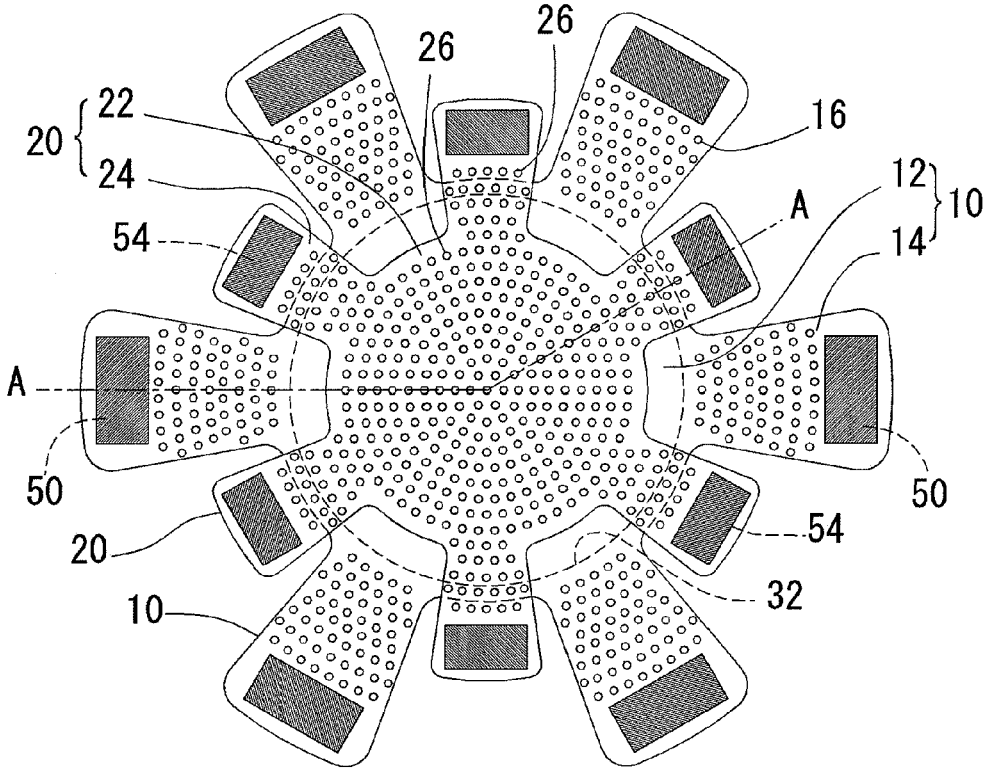
FIG. 1B
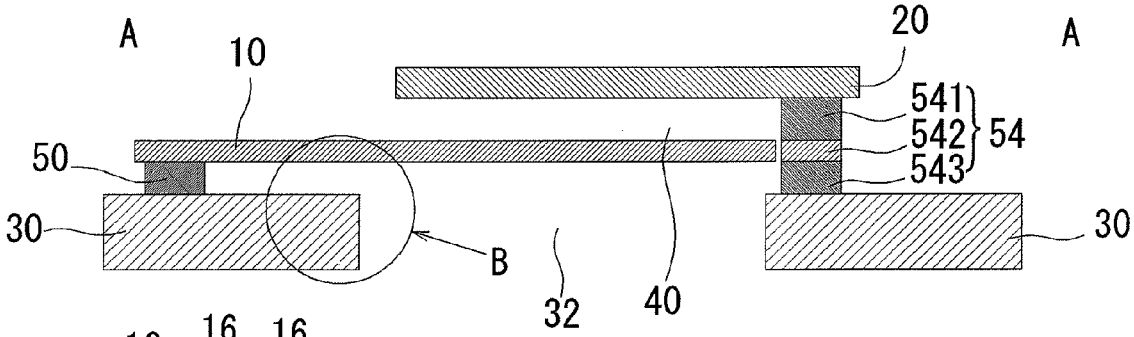
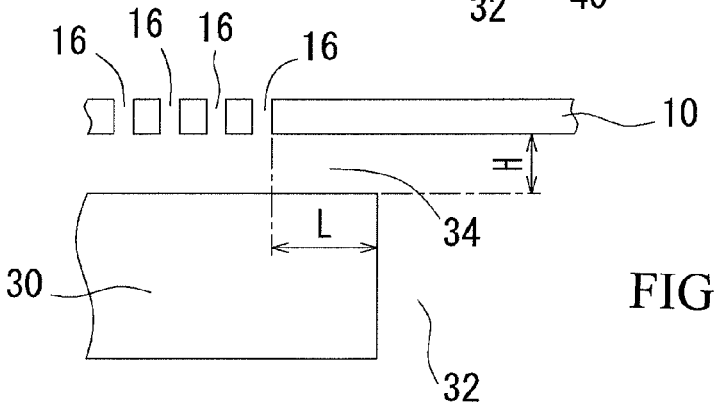
FIG. 1C

CONDENSER MICROPHONE

The present invention claims priority based on five Japanese patent applications, i.e., Japanese Patent Application No. 2006-92039 (filing date: Mar. 29, 2006), Japanese Patent Application No. 2006-92063 (filing date: Mar. 29, 2006), Japanese Patent Application No. 2006-92076 (filing date: Mar. 29, 2006), Japanese Patent Application No. 2006-278246 (filing date: Oct. 12, 2006), and Japanese Patent Application No. 2006-281902 (filing date: Oct. 16, 2006), the contents of which are incorporated herein by reference.

BACKGROUND OF THE INVENTION

1. Field of the Invention

The present invention relates to condenser microphones, which are manufactured by way of semiconductor device manufacturing processes and are adapted to MEMS (microelectromechanical system), and in particular to condenser microphones in which diaphragm vibrating due to sound waves are arranged opposite to plates so as to generate electric signals in response to variations of electrostatic capacitance therebetween.

2. Background Art

Conventionally, various types of condenser microphones manufactured by way of semiconductor device manufacturing processes have been developed. A conventionally-known condenser microphone is constituted in such a way that a diaphragm having a moving electrode, which vibrates due to sound waves, is arranged opposite to a plate having a fixed electrode, wherein the diaphragm and the plate are distanced from each other and are supported via an insulating spacer. That is, a condenser (i.e., electrostatic capacitance) is formed by means of the diaphragm and the plate, which are arranged opposite to each other.

In the aforementioned condenser microphone, when the diaphragm vibrates due to sound waves, the electrostatic capacitance varies due to the displacement thereof, so that variations of the electrostatic capacitance are converted into electric signals. The sensitivity of the condenser microphone increases when the ratio of the displacement of the diaphragm to the distance between the oppositely arranged electrodes is increased, i.e., by improving the vibration characteristics of the diaphragm. In addition, the sensitivity of the condenser microphone increases when the parasitic capacitance that does not contribute to variations of the electrostatic capacitance is decreased.

The paper issued by the Japanese Institute of Electrical Engineers and entitled "Mechanical Properties of Capacitive Silicon Microphone" teaches a condenser microphone in which a diaphragm and a plate are formed using conductive thin films. Herein, a spacer is fixed to the overall periphery of the diaphragm; hence, when sound waves are transmitted to the diaphragm, a relatively large displacement occurs in the center portion of the diaphragm, while a very small displacement occurs in the periphery of the diaphragm. As a result, vibration at the center portion of the diaphragm is efficiently detected as capacitance variations, while only the parasitic capacitance occurs in the periphery of the diaphragm. The parasitic capacitance reduces the sensitivity of the condenser microphone.

Japanese Patent Application Publication No. H09-508777 and U.S. Pat. No. 4,776,019 teach condenser microphones in which vibration characteristics of the diaphragm are improved by use of spring structures for supporting diaphragms so as to improve sensitivities. Specifically, slits are formed in the diaphragm, and spring functions are applied to regions defined by the slits. However, since the plate is arranged to entirely correspond to the diaphragm having the spring function, a parasitic capacitance occurs in a region causing small displacement due to vibration of the diaphragm, whereby the sensitivity of the condenser microphone decreases.

Japanese Patent Application Publication No. 2004-506394 teaches a condenser microphone, in which a plate arranged opposite to a diaphragm having a moving electrode is formed using an insulating material, and a rear electrode is arranged only in the prescribed portion of the plate positioned opposite to the center portion of the diaphragm, so that variations of electrostatic capacitance are efficiently detected in correspondence with the center portion of the diaphragm, thus reducing the parasitic capacitance at the periphery of the diaphragm and thus improving the sensitivity. However, since the rear electrode is arranged only in the prescribed portion of the plate positioned opposite to the center portion of the diaphragm, the manufacturing process becomes complex and the manufacturing yield decreases, thus increasing the manufacturing cost. When a gap is formed by removing a sacrifice layer intervened between the diaphragm and the plate by way of etching, the insulating material for fixing the plate and the rear electrode should be slightly etched. The countermeasure coping with this problem must be incorporated into the manufacturing process, which further increases the manufacturing cost.

The sensitivity of the condenser microphone depends upon the vibration characteristics of the diaphragm, the parasitic capacitance formed between the diaphragm and the back plate, and the rigidity of the back plate: hence, the prior-art technology for improving the sensitivity of the condenser microphone has problems in that structural complexity and operational instability occur, and the manufacturing yield becomes low due to the complex manufacturing process.

For example, it is possible to adopt a countermeasure in which, in order to reduce the parasitic capacitance, a plurality of small holes are formed in the region of the back plate positioned opposite to the periphery of the diaphragm so as to reduce the substantially opposite area therebetween; however, this reduces the mechanical strength of the back plate and increases the unwanted deformation of the back plate. In addition, it is possible to form projections so as to control excessive vibration of the diaphragm, whereby even when excessive sound pressure is applied to the diaphragm, or a mechanical impact is applied to the condenser microphone from the exterior, it is possible to prevent the diaphragm from coming in contact with the rear electrode arranged in the prescribed portion of the back plate. However, this requires a complex process for forming the rear electrode on the back plate composed of the insulating material, which reduces the manufacturing yield and increases the manufacturing cost.

SUMMARY OF THE INVENTION

It is an object of the present invention to provide a condenser microphone, which improves vibration characteristics of a diaphragm without making the manufacturing process complex and which reduces a parasitic capacitance between the diaphragm and a plate, thus increasing the sensitivity.

According to a first aspect of the present invention, in a condenser microphone including a diaphragm having a conductivity, which includes a center portion and a plurality of arms extended externally in a radial manner and which vibrates due to sound waves, a back plate having a conductivity, which is positioned opposite to the diaphragm, a substrate, which is positioned opposite to the back plate so as to face the diaphragm and which has a cavity for relaxing pressure applied to the diaphragm, and a support member, which supports the diaphragm above the substrate while insulating the tip ends of the arms of the diaphragm from the external periphery of the diaphragm, thus forming a gap between the center portion of the diaphragm and the back plate, a high acoustic resistance, which is higher than an acoustic resistance formed between the plurality of arms, is formed between the substrate surrounding the cavity and the diaphragm.

In the aforementioned constitution, the diaphragm having a gear-like shape is improved in vibration characteristics, and the external circumference of the back plate is not positioned oppositely at the cutouts formed between the arms of the diaphragm; hence, it is possible to avoid the occurrence of a parasitic capacitance. In addition, the diaphragm and the back plate can be easily manufactured using conductive materials. Furthermore, a high acoustic resistance is formed between the substrate surrounding the cavity and the diaphragm, it is possible to prevent sound waves reaching the diaphragm from being transmitted between the arms. That is, with a simple manufacturing process, it is possible to improve the vibration characteristics of the diaphragm, and it is possible to reduce the unwanted parasitic capacitance between the diaphragm and the back plate; hence, it is possible to improve the sensitivity of the condenser microphone.

It is preferable that the distance from the center to the external end of the back plate be shorter than the distance from the center of the center portion of the diaphragm to the tip end of the arm. Thus, it is possible to further reduce the parasitic capacitance. Since the size of the back plate is reduced in comparison with the diaphragm, it is possible to increase the rigidity of the back plate; hence, it is possible to enlarge the size of the diaphragm without degrading the operation stability of the condenser microphone.

It is preferable that cutout be formed in the back plate at the positions opposite to the arms of the diaphragm. Thus, no parasitic capacitance occurs between the back plate and the arms of the diaphragm so that the electrostatic capacitance is formed between the back plate and the center portion of the diaphragm; hence, it is possible to reduce the ratio of the parasitic capacitance.

It is preferable that the support member be constituted of a first support for supporting the tip ends of the arms of the diaphragm and a second support, which is positioned between the arms of the diaphragm so as to support the back plate. Since only the tip ends of the arms of the diaphragm are supported by the first support, it is possible to improve the vibration characteristics of the diaphragm in comparison with the prior-art technology in which the overall periphery of the diaphragm is fixed. Since the second support for supporting the external periphery of the back plate is positioned to match the cutouts formed between the arms of the diaphragm, it is possible to reduce the size of the back plate compared with the diaphragm; hence, it is possible to increase the rigidity of the back plate. Furthermore, since the diaphragm and the back plate are directly supported above the substrate, it is possible to manufacture the condenser microphone with a simple manufacturing process.

It is preferable that the cavity has an opening formed along the inside of the center portion of the diaphragm. That is, the opening of the cavity is formed to substantially match the center portion of the diaphragm, so that the cavity has a sufficiently large volume. As a result, the spring constant of the air inside of the cavity becomes adequately small; hence, it is possible to maintain good vibration characteristics of the diaphragm. Due to the formation of a passage having a high acoustic resistance, which is higher than the acoustic resistance between the arms of the diaphragm, it is possible to prevent sound waves reaching the diaphragm from being transmitted between the arms.

It is possible for the cavity to have an opening formed along and inwardly of the external end of the diaphragm. In this case, the opening of the cavity is formed to entirely match the diaphragm; hence, the cavity has a sufficiently large volume; thus, it is possible to maintain good vibration characteristics of the diaphragm.

It is preferable that a plurality of holes be formed in the arms of the diaphragm. Thus, it is possible to reduce the rigidity of the arms of the diaphragm; this makes it easy for the arms to be deformed in a vibration mode of the diaphragm, and this increases the displacement of the center portion. Thus, it is possible to further improve the vibration characteristics of the diaphragm. In the manufacturing process, an etching solution is infiltrated via the holes of the arms of the diaphragm so as to remove a sacrifice layer intervened between the arms of the diaphragm and the substrate by way of etching, thus forming a gap. That is, by forming the holes in the arms of the diaphragm, it is possible to simplify the manufacturing process, and it is possible to further improve the vibration characteristics of the diaphragm; thus, it is possible to improve the sensitivity of the condenser microphone.

Alternatively, the condenser microphone can be constituted of a back plate having a conductivity, which includes a center portion and a plurality of arms extended externally in a radial manner, a diaphragm having a conductivity, which is positioned opposite to the back plate so as to vibrate due to sound waves, a substrate, which is positioned opposite to the back plate so as to face the diaphragm and which has a cavity for relaxing pressure applied to the diaphragm, and a support member, which supports the diaphragm above the substrate while insulating the external periphery of the diaphragm from the tip ends of the arms of the back plate, thus forming a gap between the diaphragm and the center portion of the back plate. In this case, it is preferable that cutouts be formed in the diaphragm at the positions opposite to the arms of the back plate.

According to a second aspect of the present invention, the support member adapted to the aforementioned condenser microphone is constituted of a spacer whose lower surface joins the tip ends of the plurality of arms of the diaphragm, a bridge whose inner end joins the upper surface of the spacer, a first support having an insulating property, which supports the outer end of the bridge above the support, and a second support having an insulating property, which supports the external periphery of the back plate above the substrate, wherein a gap is formed between the center portion of the diaphragm and the back plate.

As described above, due to the structure in which the diaphragm joins the bridge supported above the substrate by means of the first support via the spacer, it is possible to relax the stress of the diaphragm, and it is possible to further improve the vibration characteristics.

It is preferable that the second support be positioned between the plurality of arms of the diaphragm. That is, since the second support for supporting the external periphery of the back plate is positioned to match the cutouts formed between the plurality of arms of the diaphragm, it is possible to reduce the size of the back plate compared with the diaphragm. This makes it possible to increase the rigidity of the back plate; hence, it is possible to enlarge the diaphragm without damaging the operation stability of the condenser microphone. Due to the structure in which the diaphragm and the back plate are independently supported above the substrate, it is possible to produce the condenser microphone with a simple manufacturing process.

It is preferable that the bridge be composed of the same material as the back plate and be formed simultaneously with the back plate. Thus, without the necessity of a special process for the formation of the bridge, it is possible to simplify the manufacturing process of the condenser microphone. It is preferable that a plurality of holes be formed in the bridge. This reduces the rigidity of the bridge; this makes it easy for the bridge to be deformed in a vibration mode of the diaphragm; and this increases the displacement of the center portion of the diaphragm; hence, it is possible to further improve the vibration characteristics of the diaphragm. Furthermore, an etching solution is infiltrated via the holes of the bridge so as to remove a sacrifice layer intervened between the back plate and the diaphragm by way of etching, thus forming a gap therebetween.

It is preferable that a high acoustic resistance, which is higher than the acoustic resistance between the plurality of arms of the diaphragm, be formed between the substrate surrounding the cavity and the diaphragm. Thus, it is possible to prevent sound waves reaching the diaphragm from being transmitted between the plurality of arms; hence, it is possible to further improve the sensitivity of the condenser microphone.

According to a third aspect of the present invention, the support member adapted to the aforementioned condenser microphone, is constituted of a first support having an insulating property, which supports a peripheral portion of the diaphragm, and a plurality of second supports, which are inserted into a plurality of holes formed in the center portion of the diaphragm so as to support the back plate above the substrate. This limits the size of the back plate to match only the size of the center portion of the diaphragm; hence, it is possible to downsize the condenser microphone. Due to the increase of the mechanical strength of the back plate, even when a voltage applied between the diaphragm and the back plate is increased for the purpose of the improvement of the sensitivity of the condenser microphone, it is possible to avoid the deformation of the back plate due to the electrostatic attraction occurring between the opposite electrodes, and it is possible to avoid the deformation of the back plate due to an impact from the exterior; hence, it is possible to improve the vibration characteristics of the diaphragm. In addition, it is possible to secure the operation stability of the condenser microphone. Since the back plate is directly supported above the substrate by means of the plurality of second supports, the back plate can be held in a stable manner. Since the peripheral portion of the diaphragm is not positioned opposite to the back plate, no parasitic capacitance occurs between them.

In the above, it is preferable that a stopper layer having an insulating property be arranged in the gap formed between the diaphragm and the back plate. Thus, even when excessive sound pressure is applied to the diaphragm, or even when an impact is applied to the condenser microphone from the exterior, it is possible to avoid excessive deformation of the diaphragm due to intervention of the stopper layer; hence, it is possible to prevent the diaphragm from coming in contact with the back plate. It is preferable that the stopper layer be fixed to the second supports. That is, the stopper layer is directly supported above the substrate in a stable manner by means of the second supports; hence, it is possible to reliably prevent the diaphragm from coming in contact with the back plate.

It is preferable that a plurality of small holes be formed respectively in a plurality of regions of the peripheral portion of the diaphragm positioned opposite to the substrate. This reduces the rigidity of the diaphragm so that the diaphragm is easily deformed and the displacement of the center portion increases in a vibration mode; hence, it is possible to improve the vibration characteristics of the diaphragm. Incidentally, the plurality of holes are formed only in the plurality of regions positioned opposite to the substrate but they are not formed in other regions positioned opposite to the cavity; hence, sound waves reaching the diaphragm are not transmitted through the plurality of holes without contributing to vibration.

The present invention demonstrates effects, in which, with a simple manufacturing process, the vibration characteristics of the diaphragm are improved, and the unwanted parasitic capacitance between the diaphragm and the back plate is reduced, so that the sensitivity of the condenser microphone is improved. Specifically, it is possible to improve the vibration characteristics of the diaphragm having a gear-like shape; and it is possible to avoid the occurrence of parasitic capacitance because the external periphery of the back plate is not positioned oppositely at the cutouts formed between the arms of the diaphragm. Since a high acoustic resistance is formed between the substrate surrounding the cavity and the diaphragm, it is possible to prevent sound waves reaching the diaphragm from being transmitted between the arms. Since the size of the back plate is reduced in comparison with the diaphragm, it is possible to increase the rigidity of the back plate; hence, it is possible to increase the size of the diaphragm without degrading the operation stability of the condenser microphone. Since the cavity has an opening formed inwardly of the external periphery of the diaphragm, it has a sufficiently large volume; hence, it is possible to maintain good vibration characteristics of the diaphragm. Due to the formation of the plurality of holes in the arms of the diaphragm, the rigidity of the arms of the diaphragm decreases so that the arms can be easily deformed in a vibration mode of the diaphragm, thus increasing the displacement of the center portion. An etching solution is infiltrated via the holes of the arms of the diaphragm so as to remove a sacrifice layer intervened between the arms of the diaphragm and the substrate by way of etching, thus forming the gap. Thus, it is possible to further improve the vibration characteristics of the diaphragm.

When the support member adapted to the condenser microphone of the present invention is constituted of the spacer, the bridge, the first support, and the second support, the diaphragm joins the bridge supported above the substrate by means of the first support via the spacer; hence, it is possible to relieve the stress of the diaphragm, and it is possible to further improve the vibration characteristics. In addition, a plurality of holes are formed in the bridge so as to reduce the rigidity, wherein an etching solution is infiltrated via the holes so as to remove a sacrifice layer intervened between the back plate and the diaphragm, thus forming a gap between them. Thus, it is possible to further improve the vibration characteristics of the diaphragm.

When the support member adapted to the condenser microphone of the present invention is constituted of the first support having an insulating property, which supports the peripheral portion of the diaphragm and a plurality of second supports having insulating property, which are inserted into the plurality of holes formed in the center portion of the diaphragm so as to support the back plate above the substrate, it is possible to improve the vibration characteristics of the diaphragm, and it is possible to increase the mechanical strength of the back plate. That is, even when a voltage applied between the diaphragm and the back plate is increased for the purpose of the improvement of the sensitivity of the condenser microphone, it is possible to avoid deformation of the back plate due to the electrostatic attraction occurring between the opposite electrodes, and it is possible to avoid deformation of the back plate due to an impact from the exterior; hence, it is possible to improve the vibration characteristics of the diaphragm, and it is possible to secure the operation stability of the condenser microphone. Furthermore, since the stopper layer having an insulating property is arranged in the gap formed between the diaphragm and the back plate, even when excessive sound pressure is applied to the diaphragm, or even when a mechanical impact is applied to the condenser microphone from the exterior, it is possible to avoid the excessive deformation of the diaphragm due to the intervention of the stopper layer; hence, it is possible to prevent the diaphragm from coming in contact with the back plate.

Furthermore, a plurality of small holes are formed in a plurality of regions of the peripheral portion of the diaphragm positioned opposite to the substrate so as to reduce the rigidity of the diaphragm; this makes it easy for the diaphragm to be easily deformed in a vibration mode, and this increases the displacement of the center portion; hence, it is possible to improve the vibration characteristics of the diaphragm. Incidentally, the plurality of holes are formed only in the plurality of regions positioned opposite to the substrate and are not formed in other regions; hence, sound waves reaching the diaphragm are not transmitted through the plurality of holes without contributing to vibration.

BRIEF DESCRIPTION OF THE DRAWINGS

FIG. 1A is a plan view showing the constitution of a condenser microphone in accordance with a first embodiment of the present invention.

FIG. 1B is a cross-sectional view taken along line A-A in FIG. 1A.

FIG. 1C is a fragmentary enlarged view of FIG. 1B.

PREFERRED EMBODIMENTS

Figure 2A:
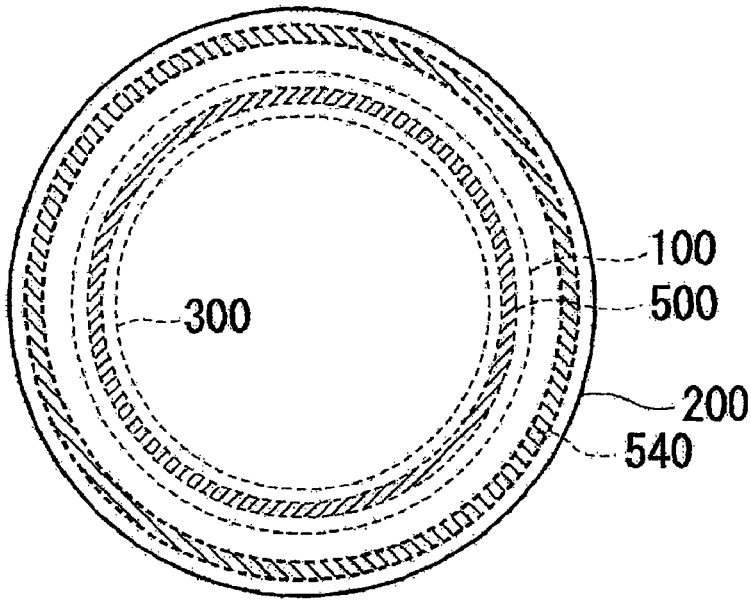
FIG. 2A is a plan view showing a condenser microphone having a conventionally-known structure.

The preferred embodiments of the present invention will be described in detail with reference to the accompanying drawings. Incidentally, the same constituent elements are designated by the same reference numerals in the embodiments.

First Embodiment

The constitution of a condenser microphone according to a first embodiment of the present invention will be described with reference to FIG. 1. FIG. 1A is a plan view showing the constitution of the condenser microphone according to the first embodiment; FIG. 1B is a cross-sectional view taken along line A-A in FIG. 1A; and FIG. 1C is an enlarged view of a portion denoted by B in the cross-sectional view of FIG. B. The condenser microphone shown in FIGS. 1A to 1C is constituted of a diaphragm 10, a back plate 20, and a substrate 30 having a support member having an insulating property. The diaphragm 10 and the back plate 20 each have electrodes, wherein they are positioned opposite to each other and are supported by means of the support member having the insulating property.

The diaphragm 10 is a thin film having a conductivity, which is composed of polysilicon added with phosphorus (P) as impurities, wherein it is constituted of a disk-like center portion 12 and six arms 14 expanded externally in a radial manner, so that it collectively has a gear-like shape. A plurality of holes 16 are formed in the six arms respectively. The thickness of the diaphragm 10 is approximately 0.5 μm; the radius of the center portion 12 is approximately 0.35 mm; and the length of the arm 14 is approximately 0.15 mm.

The back plate 20 is arranged in parallel with the diaphragm 10 via a gap 40 of approximately 4 μm, for example. The back plate 20 is a thin film having a conductivity, which is composed of polysilicon added with phosphorus, wherein it is constituted of a disk-like center portion 22 and six arms 24 expanded externally in a radial manner, so that it collectively has a gear-like shape. A plurality of holes 26 are formed in the center portion 22 and the arms 24 of the back plate 20. The holes 26 of the back plate 20 function as sound holes that pass sound waves emitted from the exterior therethrough so as to transmit them toward the diaphragm 10. The thickness of the back plate 20 is approximately 1.5 μm; the radius of the center portion 22 is approximately 0.3 mm; and the length of the arm 24 is approximately 0.1 mm.

The center portion 22 of the back plate 20 is arranged concentrically with the center portion 12 of the diaphragm 10, wherein the radius of the center portion 22 of the back plate 20 is smaller than the radius of the center portion 12 of the diaphragm 10. In addition, the six arms 24 of the back plate 20 are arranged alternately with the arms 14 of the diaphragm 10, wherein each of the arms 24 is positioned between the adjacent arms 14. In other words, each of the arms 14 is positioned between the adjacent arms 24. The distance between the center of the center portion 22 of the back plate 20 and the tip end of the arm 24 is longer than the radius of the center portion 12 of the diaphragm 10 but is smaller than the distance between the center of the center portion 12 of the diaphragm 10 and the tip end of the arm 14.

The tip end of the arm 14 of the diaphragm 10 is supported above the substrate 30 by means of a first support 50 having an insulating property. The tip end of the arm 24 of the back plate 20 is supported by means of a second support 54 having an insulating property. The second support 54 is arranged at a position defined between the arms 14 of the diaphragm 10. Incidentally, it is possible to form a plurality of cutouts in the diaphragm 10 so that the arms 14 are formed between the cutouts.

The first support 50 is composed of a silicon oxide film, for example. The second support 54 is constituted of insulating films 541 and 543 and a conductive film 542. The insulating films 541 and 543 are composed of silicon oxide films, for example. It is preferable that the conductive film 542 be formed simultaneously with the formation of the diaphragm 10 having a conductivity, wherein it is composed of polysilicon added with phosphorus impurities. The conductive film 542 is placed at the same potential with the back plate 20 and the substrate 30, so that it functions as a guard electrode for reducing the parasitic capacitance of the condenser microphone. Incidentally, it is possible to omit the conductive film 542.

The substrate is constituted of a silicon substrate whose thickness ranges from 500 μm to 600 μm, for example, wherein a cavity 32 runs through the substrate in conformity with the center portion 12 of the diaphragm 10, so that the diaphragm 10 is exposed. The cavity 32 is formed along the inside of the center portion 12 of the diaphragm 10, so that it function as a pressure relaxation room for relaxing pressure that is applied to the diaphragm 10 oppositely to the back plate 20. In addition, a passage 34 is a space formed between the substrate 30 existing in the vicinity of the cavity 32 and the diaphragm 10, wherein it has a high acoustic resistance that is higher than an acoustic resistance between the arms 14 of the diaphragm 10. As shown in FIG. 1C, the acoustic resistance is controlled based on a height H (i.e., the distance between the diaphragm 10 and the substrate 30) and a length L (i.e., the distance from an innermost hole 16 within the plurality of holes 16 formed in the arm 14 of the diaphragm 10 to the end portion of the cavity 32, or the distance from the end portion of the center portion 12 of the diaphragm 10 to the end portion of the cavity 32) of the passage 34, thus realizing a high acoustic resistance that is higher than the acoustic resistance between the arms 14 of the diaphragm 10. Thus, it is possible to prevent sound waves, which are transmitted to the diaphragm 10, from propagating between and leaking between the arms 14. For example, the height H of the passage 34 is 2 μm, and the length L is 15 μm.

Figure 29A:
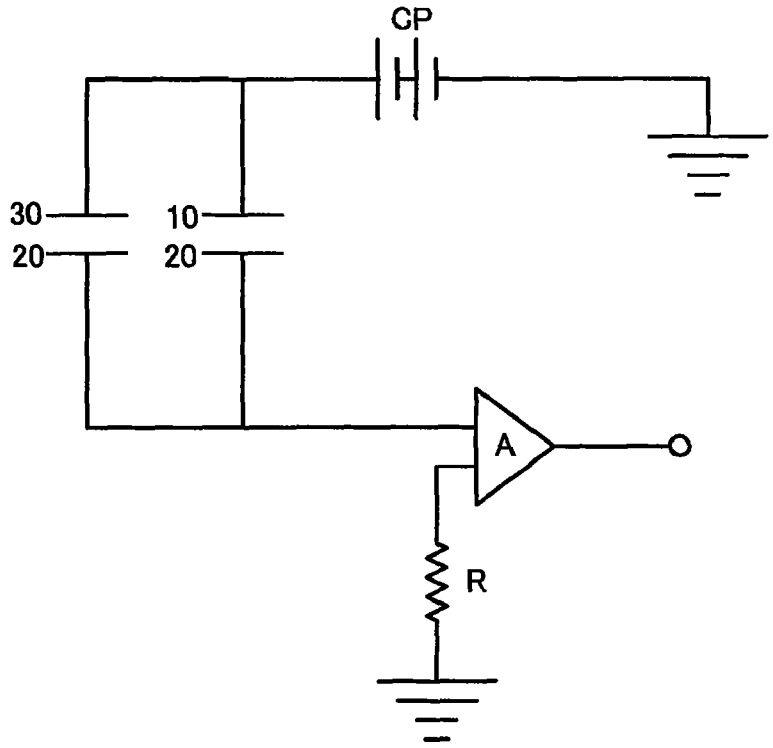
FIG. 29A is a circuit diagram showing the constitution of a detection circuit that converts variations of electrostatic capacitance formed between a diaphragm and a back plate into electric signals.

FIG. 29A is a circuit diagram showing the constitution of a detection circuit that converts variations of electrostatic capacitance formed between the diaphragm 10 and the back plate 20 into electric signals. A stable bias voltage is applied to the diaphragm 10 by means of a charge pump CP. Variations of electrostatic capacitance between the back plate 20 and the diaphragm 10 are input into a pre-amplifier A in the form of voltage variations. Since the substrate 30 and the diaphragm 10 are short-circuited, a parasitic capacitance occurs between the back plate 20 and the substrate 30 without the intervention of the conductive film 542.

Figure 29B:
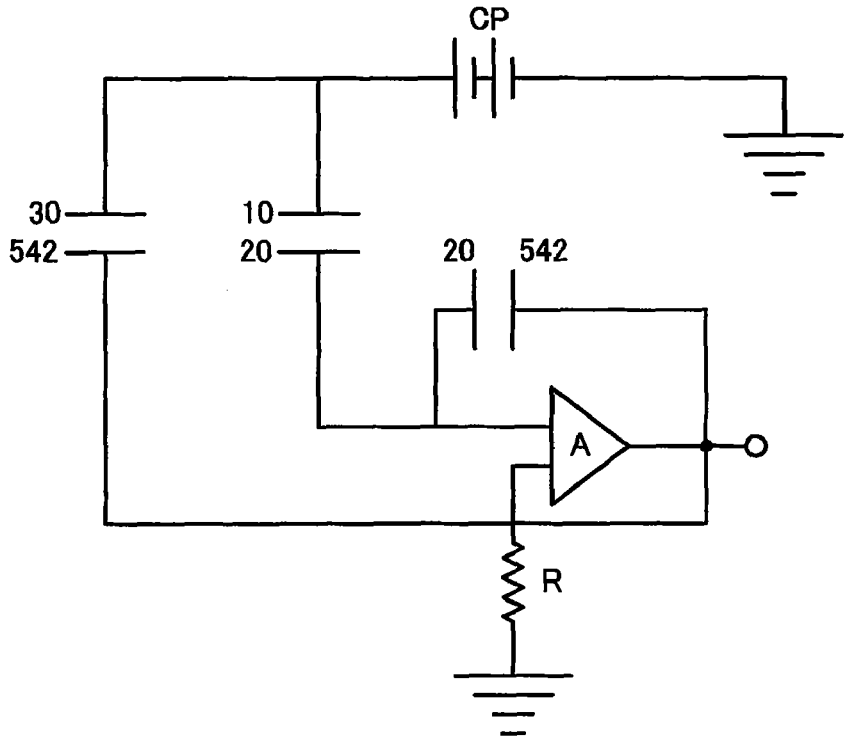
FIG. 29B is a circuit diagram showing the constitution of a detection circuit arranging a conductive film.

FIG. 29B shows the constitution of a detection circuit arranging the conductive film 542. Herein, the pre-amplifier A forms a voltage-follower circuit so as to make the conductive film 542 function as a guard electrode. That is, since the back plate 20 and the conductive film 542 are controlled to be placed at the same potential by means of the voltage-follower circuit, it is possible to remove the parasitic capacitance occurring between the back plate 20 and the conductive film 542. In addition, since the substrate 30 and the diaphragm 10 are short-circuited, the capacitance between the conductive film 542 and the substrate 30 becomes irrelevant to the output of the pre-amplifier A. As described above, since a guard electrode is formed by way of the provision of the conductive film 542, it is possible to further reduce the parasitic capacitance of the condenser microphone.

As described above, in the condenser microphone according to the first embodiment, the diaphragm 10 and the back plate 20 both have gear-like shapes, wherein the center portion 12 of the diaphragm 10 and the center portion 22 of the back plate 20 are mutually positioned opposite to each other. In a plan view, the arms 14 of the diaphragm 10 and the arms 24 of the back plate are alternately arranged with each other, wherein they are not arranged oppositely. Thus, it is possible to avoid the occurrence of an unwanted parasitic capacitance. That is, an electrostatic capacitance is formed between the center portion 12 of the diaphragm 10 and the center portion 22 of the back plate 20, whereby electric signals are produced in response to variations of the electrostatic capacitance; hence, it is possible to remarkably reduce the parasitic capacitance in the other portions of the condenser microphone, thus remarkably improving the sensitivity.

The tip ends of the arms 14 of the diaphragm 10 are supported by the first support 50. In addition, the distance from the center of the center portion 12 of the diaphragm 10 to the first support 50 is longer than the distance from the center of the center portion 22 of the back plate 20 to the second support 54 for supporting the tip ends of the arms 24. That is, it is possible to improve the vibration characteristics of the diaphragm 10 in the condenser microphone of the first embodiment compared with the conventionally-known condenser microphone, in which the overall periphery of the diaphragm is fixed, and the conventionally-known condenser microphone, in which both of the diaphragm and back plate have substantially the same shape in plan view.

In addition, the radius of the center portion 22 of the back plate 20 is smaller than the radius of the center portion 12 of the diaphragm 10, and the distance from the center of the center portion 22 to the second support 54 is shorter than the distance from the center of the center portion 12 to the first support 50. That is, it is possible to increase the rigidity of the back plate 20 in the condenser microphone of the first embodiment compared with the conventionally-known condenser microphone, in which both of the diaphragm and back plate have substantially the same shape in plan view; hence, it is possible to enlarge the diaphragm 10 without damaging the operation stability, thus improving the vibration characteristics of the diaphragm 10.

Due to the formation of the plurality of holes 16 in the arms 14 of the diaphragm 10, it is possible to reduce the rigidity of the arms 14, and this makes it possible for the arms 14 of the diaphragm 10 to be easily deformed. Thus, it is possible to further improve the vibration characteristics of the diaphragm 10.

In order to confirm the effect of the condenser microphone of the first embodiment, the inventor of the present application produces a condenser microphone having the conventionally-known structure and a condenser microphone for use in experiments, thus performing the following experiments. Specifically, FIGS. 2A and 2B are a plan view and a cross-sectional view showing the condenser microphone having the conventionally-known structure, and FIGS. 3A and 3B are a plan view and a cross-sectional view showing the condenser microphone for use in experiments.

Figure 2B:
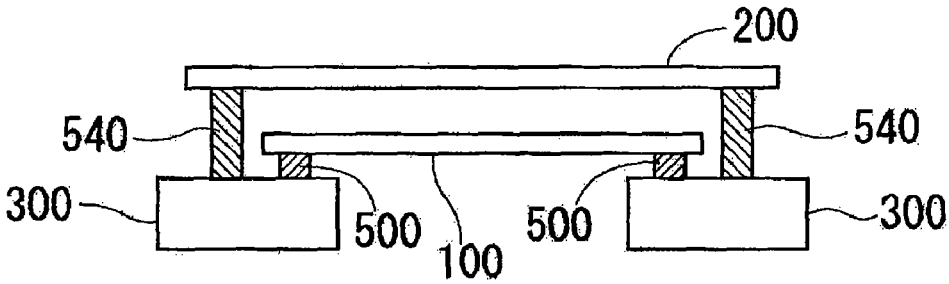
FIG. 2B is a cross-sectional view of FIG. 2A.

In the condenser microphone having the conventionally-known structure shown in FIGS. 2A and 2B, the overall periphery of a disk-like diaphragm 100 is supported above a substrate 300 by means of a first support 500. The radius of the diaphragm 100 is set identical to the distance from the center of the center portion 12 of the diaphragm 10 to the tip end of the arm 14 in the condenser microphone of the first embodiment. In addition, a disk-like back plate 200 is arranged to cover the upper surface of the diaphragm 100, wherein the overall periphery of the back plate 200 is supported above the substrate 300 by means of a second support 540.

Figure 3A:
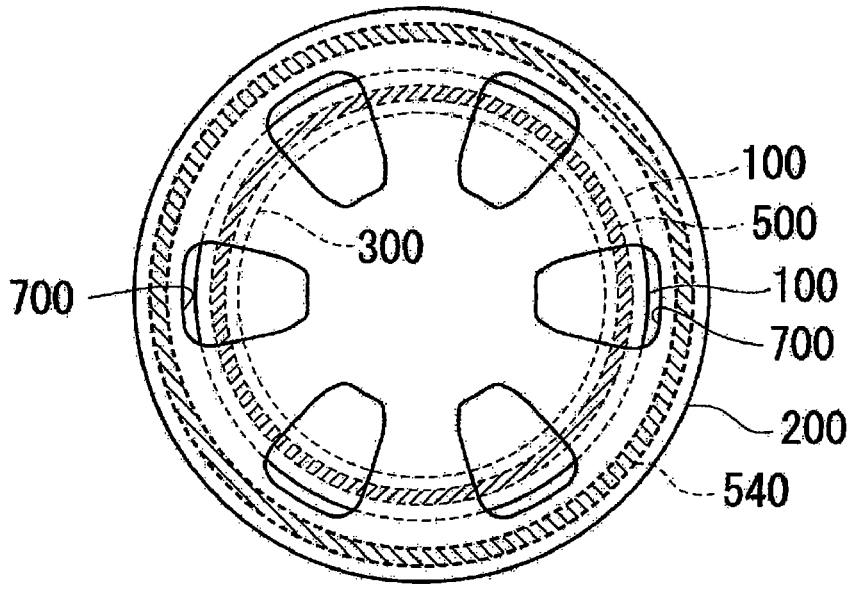
FIG. 3A is a plan view showing a condenser microphone that is prepared for use in an experiment.
Figure 3B:
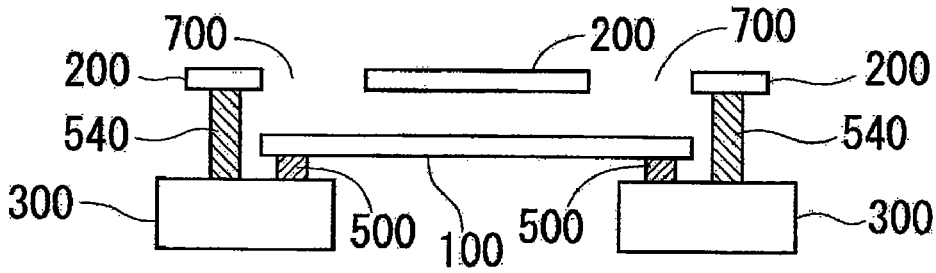
FIG. 3B is a cross-sectional view of FIG. 3A.

The condenser microphone for use in experiments shown in FIGS. 3A and 3B has substantially the same structure as the condenser microphone shown in FIGS. 2A and 2B, wherein six cutouts 700 are formed in the periphery of the back plate 200 in order to reduce the parasitic capacitance, and wherein the cutouts 700 are positioned in proximity to the external circumference supported by the first support 500 of the diaphragm 100.

Measurements are performed on the condenser microphone having the conventionally-known structure shown in FIGS. 2A and 2B, the condenser microphone for use in experiments shown in FIGS. 3A and 3B, and the condenser microphone of the first embodiment shown in FIGS. 1A, 1B, and 1C with respect to the electrode pressure resistance, vibration displacement value, and sensitivity, thus producing results shown in Table 1.

TABLE 1

| | Electrode pressure resistance | Vibration displacement value | Sensitivity |
|---|---|---|---|
| Conventionally-known structure | 1.0 | 1.0 | 1.0 |
| Experimental structure | 0.8 | — | — |
| First embodiment | 1.2 | 2.0 | 3.0 |

The electrode pressure resistance is equivalent to a value of a voltage, which is applied between the diaphragm and the back plate so that the back plate being deformed due to electrostatic attraction comes in contact with the diaphragm in the condition that a sacrifice oxide film is intervened between the diaphragm and the substrate, i.e., in the condition that the diaphragm is entirely fixed to the substrate, wherein it may define a target of the strength of the back plate.

The vibration displacement value is a value of displacement of the center portion of the diaphragm when the prescribed sound pressure is applied to the diaphragm. The sensitivity is represented by the output voltage of the condenser microphone when the prescribed sound pressure is applied to the diaphragm, wherein it is represented by the following equation.

Sensitivity•Vibration displacement value×Voltage applied between electrodes×[Electrostatic capacitance/(Electrostatic capacitance+Parasitic capacitance)]

In Table 1, numerical values are expressed as relative values calculated on the basis of the values (i.e., "1.0") representing the electrode pressure resistance, vibration displacement value, and sensitivity of the condenser microphone having the conventionally-known structure.

In the condenser microphone for use in experiments, the electrode pressure resistance is reduced to 0.8 in comparison with the condenser microphone having the conventionally-known structure. This is because reduction of the strength is caused by the formation of the cutouts 700 in the back plate 200 which reduces the parasitic capacitance. The reduction of the electrode pressure resistance makes the operation of the condenser microphone unstable.

On the other hand, in the condenser microphone of the first embodiment, even though the back plate 20 has a gear-like shape, and the cutouts are formed between the arms 24 arranged in the external circumference of the center portion 22, the electrode pressure resistance is increased 1.2 times higher in comparison with the condenser microphone having the conventionally-known structure. This is because the second support 54 for supporting the tip ends of the arms 24 of the back plate 20 is positioned at the cutouts formed between the arms 14 of the diaphragm 10, and the distance from the center of the center portion 22 of the back plate 20 to the second support 54 is shorter than the distance from the center of the diaphragm 100 to the first support 500 in the condenser microphone having the conventionally-known structure. Thus, it is possible to relatively increase the rigidity of the back plate 20, thus increasing the electrode pressure resistance. By increasing the electrode pressure resistance, it is possible to stabilize the operation of the condenser microphone of the first embodiment.

In the condenser microphone of the first embodiment, the vibration displacement value of the diaphragm 10 is increased 2.0 times higher than that of the condenser microphone having the conventionally-known structure. This is because the diaphragm 10 has a gear-like shape, and the tip ends of the arms 14 are supported by the first support 50. That is, in the condenser microphone of the first embodiment compared with the condenser microphone having the conventionally-known structure, in which the periphery of the diaphragm 100 is entirely fixed, it is possible to improve the vibration characteristics of the diaphragm 10, wherein the plurality of holes 16 formed in the arms 14 contribute to the increase of the vibration displacement value.

Furthermore, in the condenser microphone of the first embodiment, the sensitivity is increased 3.0 times higher than that of the condenser microphone having the conventionally-known structure. This is because the vibration displacement value of the diaphragm 10 is increased to be higher than that of the diaphragm 100 of the condenser microphone having the conventionally-known structure. In addition, the electrostatic capacitance is mainly formed between the center portion 12 of the diaphragm 10 and the center portion 22 of the back plate 20, and the arms 14 and the arms 24 are positionally shifted from each other so as not to cause the parasitic capacitance therebetween. That is, in the condenser microphone of the first embodiment compared with the condenser microphone having the conventionally-known structure, it is possible to remarkably reduce the parasitic capacitance.

The condenser microphone of the first embodiment is a silicon capacitor microphone, which is manufactured by way of the semiconductor device manufacturing process. Hereinafter, a manufacturing method of the condenser microphone of the first embodiment will be described with reference to FIGS. 4 to 28.

Figure 4:
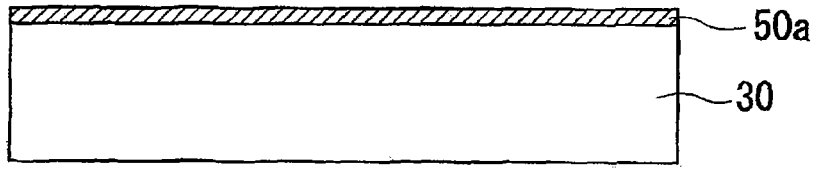
FIG. 4 is a cross-sectional view showing a first step of a manufacturing method of the condenser microphone according to the first embodiment.

First, as shown in FIG. 4, a first insulating film 50*a* of 2 μm thickness composed of a silicon oxide film is formed on the substrate 30, which is formed using a semiconductor substrate composed of monocrystal silicon, for example, by way of plasma CVD (Plasma Chemical Vapor Deposition). The first insulating film 50*a* is removed in the after-treatment, wherein it serves as a sacrifice layer that is used to form the cavity 32 in the substrate 30 below the diaphragm 10 and that is used to form the passage 34 realizing a desired acoustic resistance between the substrate 30 surrounding the cavity and the diaphragm 10. In addition, the first insulating film 50*a* is used to form the first support 50 for supporting the diaphragm 10 above the substrate 30.

Figure 5:
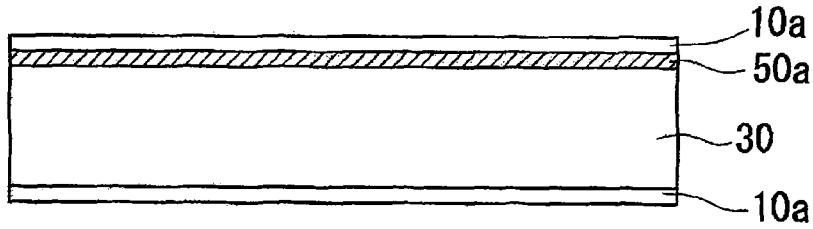
FIG. 5 is a cross-sectional view showing a second step of the manufacturing method of the condenser microphone according to the first embodiment.
Figure 6:
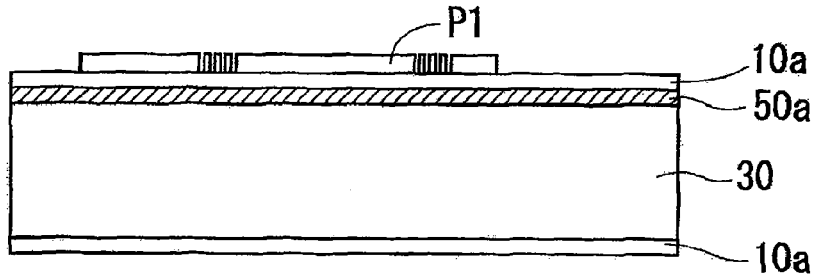
FIG. 6 is a cross-sectional view showing a third step of the manufacturing method of the condenser microphone according to the first embodiment.
Figure 7:
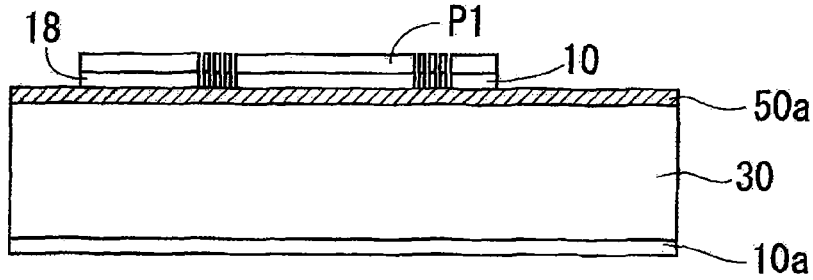
FIG. 7 is a cross-sectional view showing a fourth step of the manufacturing method of the condenser microphone according to the first embodiment.

Next, as shown in FIG. 5, a first conductive layer 10*a* of 0.5 μm thickness composed of phosphorus-doped polysilicon is formed on the first insulating film 50*a* by way of decompression CVD (Decompression Chemical Vapor Deposition). The first conductive layer 10*a* is formed on the backside of the substrate 30 as well. Next, as shown in FIG. 6, a photoresist film is applied to the entire surface of the first conductive layer 10*a* formed on the first insulating film 50*a*; then, exposure and development are performed by way of the photolithography technique using a resist mask having a prescribed shape, thus forming a photoresist pattern P1. Next, as shown in FIG. 7, anisotropic etching such as RIE (Reactive Ion Etching) is performed by use of the photoresist pattern P1 serving as a mask so as to electively remove the first conductive layer 10*a*, which is thus processed in a prescribed shape, thus forming the diaphragm 10 of 0.5 μm thickness and the wiring 18 connected thereto as well as the plurality of holes 16 of the arms 14 of the diaphragm 10.

Figure 8:
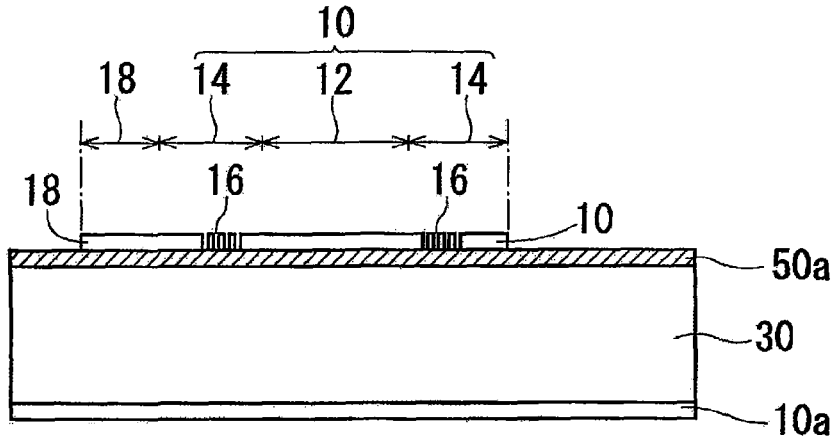
FIG. 8 is a cross-sectional view showing a fifth step of the manufacturing method of the condenser microphone according to the first embodiment.

Next, as shown in FIG. 8, incineration (ashing) using oxygen plasma ($O_2$ plasma) and dissolution for soaking into a mixed solution composed of sulfuric acid and hydrogen peroxide are performed so as to remove the photoresist pattern P1. Thus, the diaphragm 10 is formed by way of the patterning of the first conductive layer 10*a*, wherein, as shown in FIG. 1A, the diaphragm 10 has a gear-like shape constituted of the center portion 12 having a disk-like shape in plan view and the six arms 14 expanded externally in a radial manner. A plurality of holes 16 are formed in the six arms 14 respectively.

Figure 9:
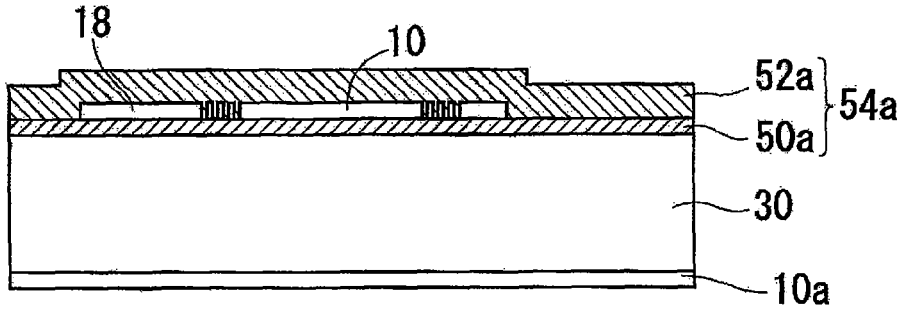
FIG. 9 is a cross-sectional view showing a sixth step of the manufacturing method of the condenser microphone according to the first embodiment.

Next, as shown in FIG. 9, a second insulating film 52*a* of 4 μm thickness composed of a silicon oxide film is formed on the diaphragm 10, the extension wire 18, and the first insulating film 50*a* by way of plasma CVD. The second insulating film 52*a* is deposited on the first insulating film 50*a* so as to form a laminated insulating film 54*a*. The second insulating film 52*a* serves as a sacrifice film for use in the formation of the gap 40 between the diaphragm 10 and the back plate 20, which is removed in the after-treatment. In the after-treatment, the laminated insulating film 54*a* is used to form the second support 54 for supporting the back plate 20 above the substrate 30.

Figure 10:
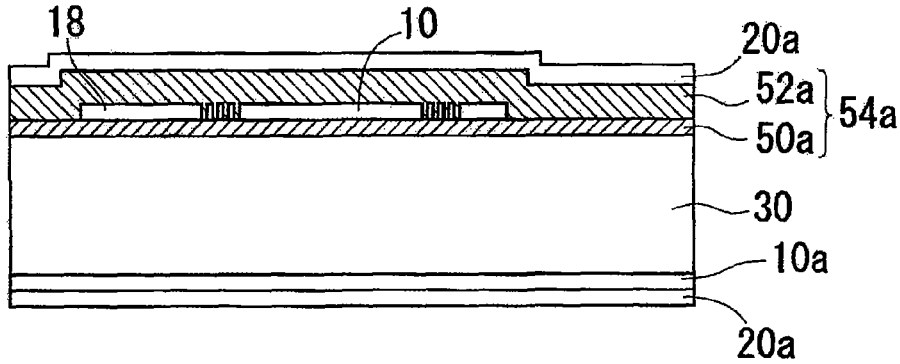
FIG. 10 is a cross-sectional view showing a seventh step of the manufacturing method of the condenser microphone according to the first embodiment.
Figure 11:
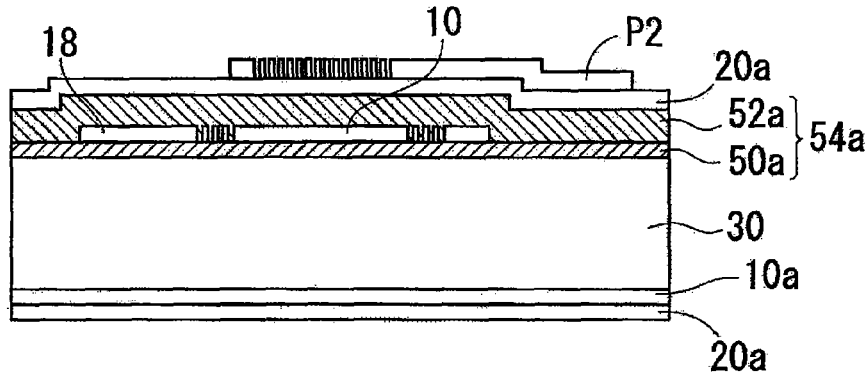
FIG. 11 is a cross-sectional view showing an eighth step of the manufacturing method of the condenser microphone according to the first embodiment.
Figure 12:
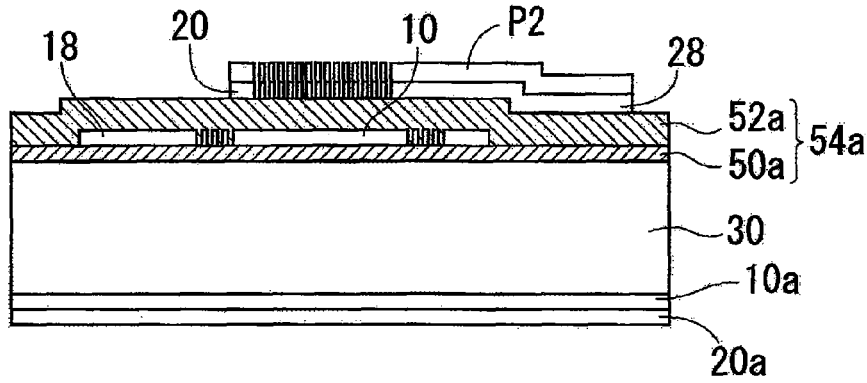
FIG. 12 is a cross-sectional view showing a ninth step of the manufacturing method of the condenser microphone according to the first embodiment.

Next, as shown in FIG. 10, a second conductive layer 20*a* of 1.5 μm thickness composed of phosphorus-doped polysilicon is formed on the second insulating film 52*a* by way of decompression CVD. The second conductive layer 20*a* is formed on the first conductive layer 10*a* at the backside of the substrate 30 as well. Next, as shown in FIG. 11, a photoresist film is applied to the entire surface of the second conductive layer 20*a* on the second insulating film 52*a*; then, a photoresist pattern P2 is formed by way of the photolithography technique. Next, as shown in FIG. 12, anisotropic etching such as RIE is performed by use of the photoresist pattern P2 serving as a mask so as to selectively remove the second conductive layer 20*a* and to process it into a prescribed shape, thus forming the back plate 20 of 1.5 μm thickness and an extension wire 28 connected thereto and thus forming a plurality of holes 26 in the center portion 22 of the back plate 20.

Figure 13:
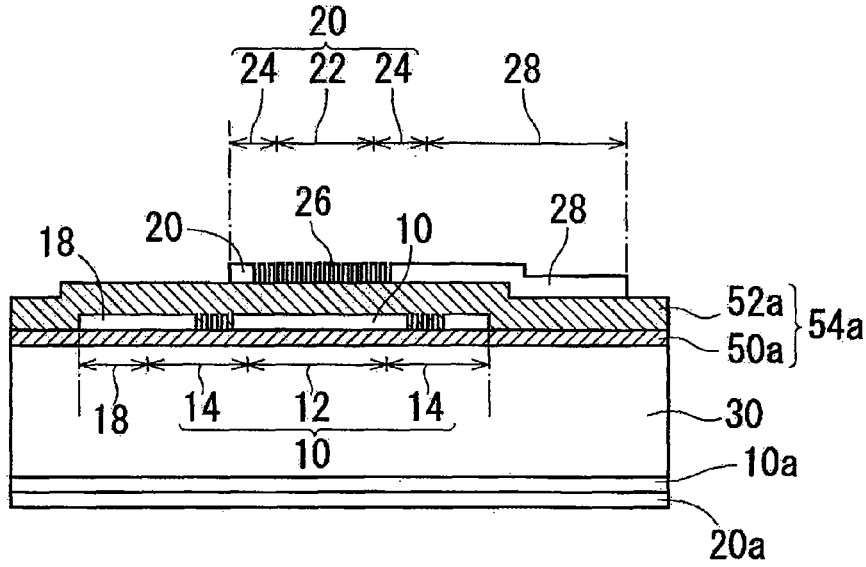
FIG. 13 is a cross-sectional view showing a tenth step of the manufacturing method of the condenser microphone according to the first embodiment.

Next, as shown in FIG. 13, incineration and dissolution using a mixed solution composed of sulfuric acid and hydrogen peroxide are performed so as to remove the photoresist pattern P2; then, heat treatment is performed for the purpose of quenching. As described above, as shown in FIG. 1A, the back plate 20 formed by way of the patterning of the second conductive layer 20*a* has a gear-like shape including the center portion 22 having a disk-like shape in plan view and the six arms 24 extended externally in a radial manner, wherein a plurality of holes 26 are formed in the center portion 22 and the six arms 24 respectively.

As shown in FIG. 1A, the center portion 22 of the back plate 20 is arranged concentrically with the center portion 12 of the diaphragm 10, wherein the radius of the center portion 22 of the back plate 20 is smaller than the radius of the center portion 12 of the diaphragm 10. In addition, the six arms 24 of the back plate 20 are positioned at the cutouts formed between the six arms 14 of the diaphragm 10. In other words, the six arms 14 of the diaphragm 10 are positioned at the cutouts formed between the six arms 24 of the back plate 20. Furthermore, the distance from the center of the center portion 22 of the back plate 20 to the tip end of the arm 24 is longer than the radius of the center portion 12 of the diaphragm 10 but is shorter than the distance from the center of the center portion 12 of the diaphragm 10 to the tip end of the arm 14.

Figure 14:
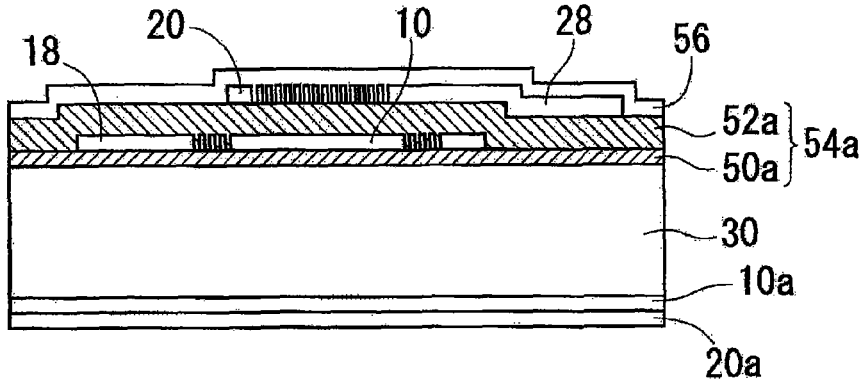
FIG. 14 is a cross-sectional view showing an eleventh step of the manufacturing method of the condenser microphone according to the first embodiment.
Figure 15:
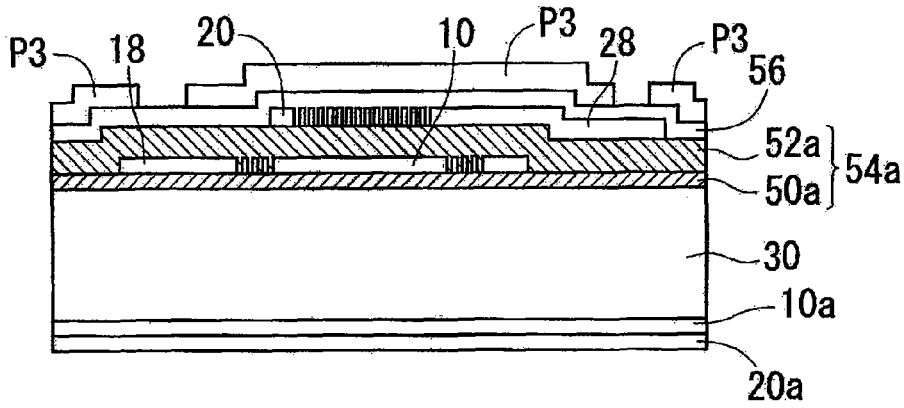
FIG. 15 is a cross-sectional view showing a twelfth step of the manufacturing method of the condenser microphone according to the first embodiment.

Next, as shown in FIG. 14, a third insulating film 56 of 0.3 μm thickness composed of a silicon oxide film is formed on the back plate 20 and its extension wire 28 as well as the second insulating film 52*a* by way of plasma CVD. Next, as shown in FIG. 15, a photoresist is applied to the entire surface of the third insulating film 56; then, a photoresist pattern P3 is formed by way of the photolithography technique. The photoresist pattern P3 has openings above the extension wire 18 connected to the diaphragm 10 and the extension wire 28 connected to the back plate 20.

Figure 16:
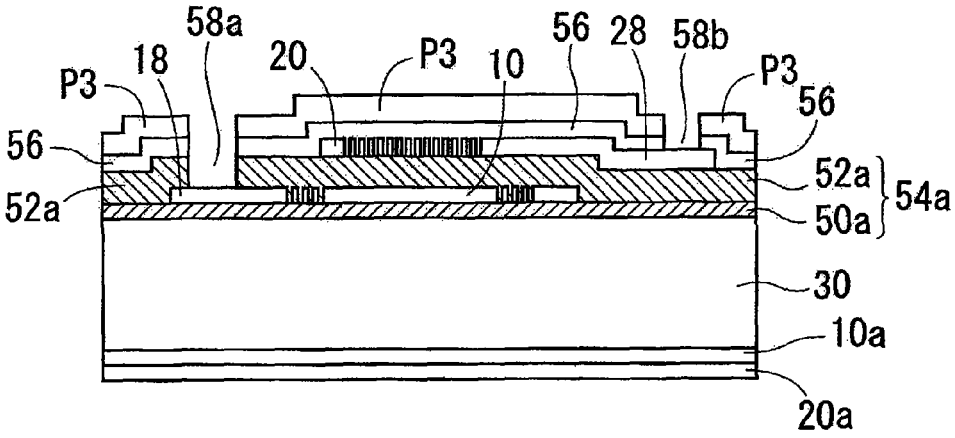
FIG. 16 is a cross-sectional view showing a thirteenth step of the manufacturing method of the condenser microphone according to the first embodiment.
Figure 17:
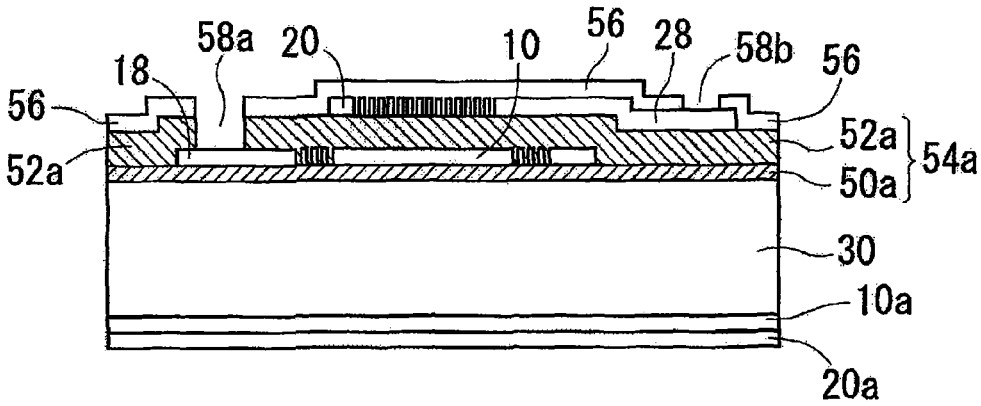
FIG. 17 is a cross-sectional view showing a fourteenth step of the manufacturing method of the condenser microphone according to the first embodiment.

Next, as shown in FIG. 16, one or both of wet etching and dry etching is performed by use of the photoresist pattern P3 serving as a mask so as to selectively remove the third insulating film 56 and the second insulating film 52*a*, thus forming electrode exposing holes 58*a* and 58*b* for exposing the extension wires 18 and 28. Next, as shown in FIG. 17, incineration and dissolution using a mixed solution composed of sulfuric acid and hydrogen peroxide are performed so as to remove the photoresist pattern P3.

Figure 18:
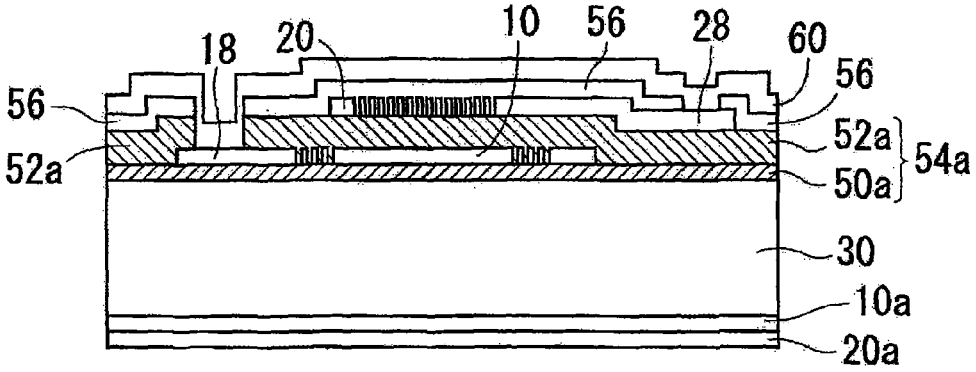
FIG. 18 is a cross-sectional view showing a fifteenth step of the manufacturing method of the condenser microphone according to the first embodiment.
Figure 19:
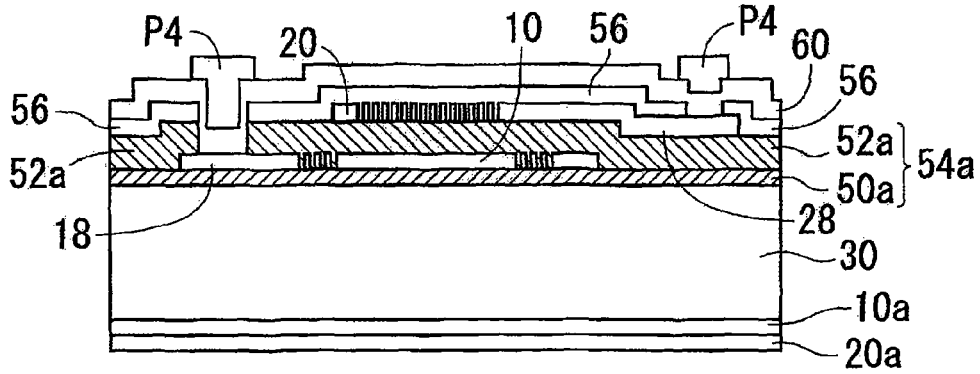
FIG. 19 is a cross-sectional view showing a sixteenth step of the manufacturing method of the condenser microphone according to the first embodiment.
Figure 20:
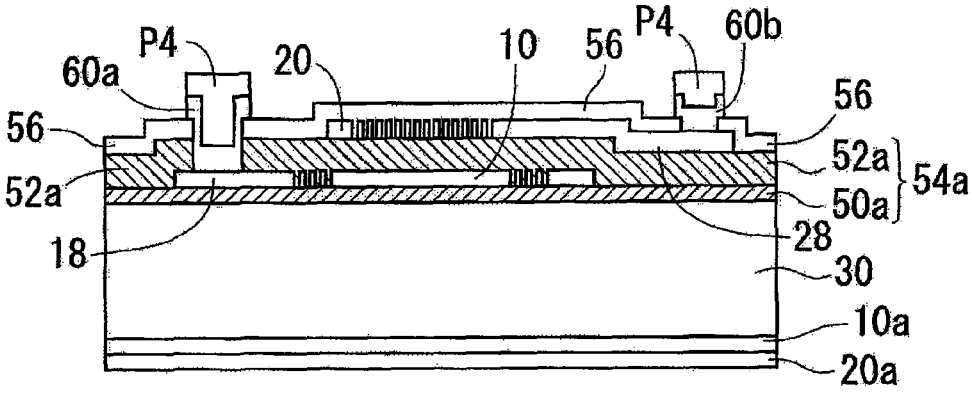
FIG. 20 is a cross-sectional view showing a seventeenth step of the manufacturing method of the condenser microphone according to the first embodiment.

Next, as shown in FIG. 18, a metal layer 60 composed of Al—Si is deposited on the entire surface of the third insulating film 56 including the extension wires 18 and 28 exposed in the electrode exposing holes 58*a* and 58*b*. Next, as shown in FIG. 19, a photoresist film is applied to the entire surface of the metal layer 60; then, a photoresist pattern P4 covering the electrode exposing holes 58*a* and 58*b* is formed by way of the photolithography technique. Next, as shown in FIG. 20, wet etching using a mixed acid is performed by use of the photoresist pattern P4 serving as a mask so as to selectively remove the metal layer 60 and to process it into a prescribed shape, thus forming a first electrode 60*a* and a second electrode 60*b*, which are connected to the extension wires 18 and 28 via the electrode exposing holes 58*a* and 58*b* respectively.

Figure 21:
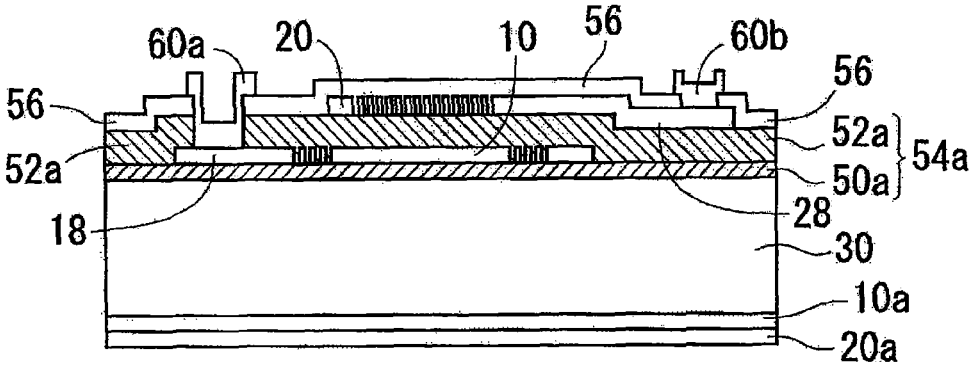
FIG. 21 is a cross-sectional view showing an eighteenth step of the manufacturing method of the condenser microphone according to the first embodiment.

Next, as shown in FIG. 21, incineration using $O_2$ plasma and dissolution for soaking into an organic peeling solution are performed so as to remove the photoresist pattern P4. Thus, the first electrode 60*a* is connected to the diaphragm 10 via the extension wire 18, and the second electrode 60*b* is connected to the back plate 20 via the extension wire 28.

Figure 22:
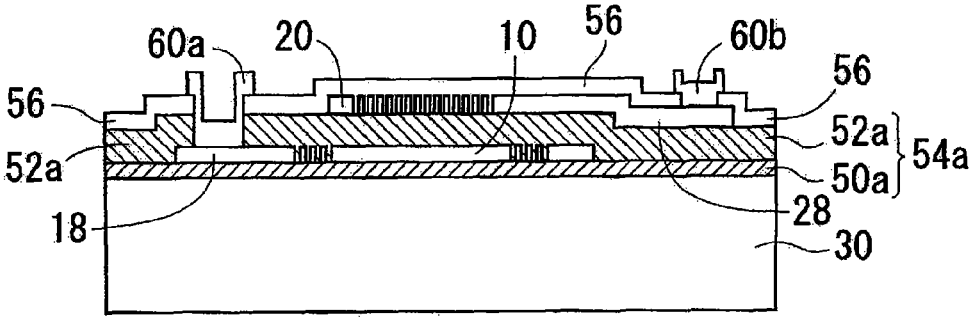
FIG. 22 is a cross-sectional view showing a nineteenth step of the manufacturing method of the condenser microphone according to the first embodiment.
Figure 23:
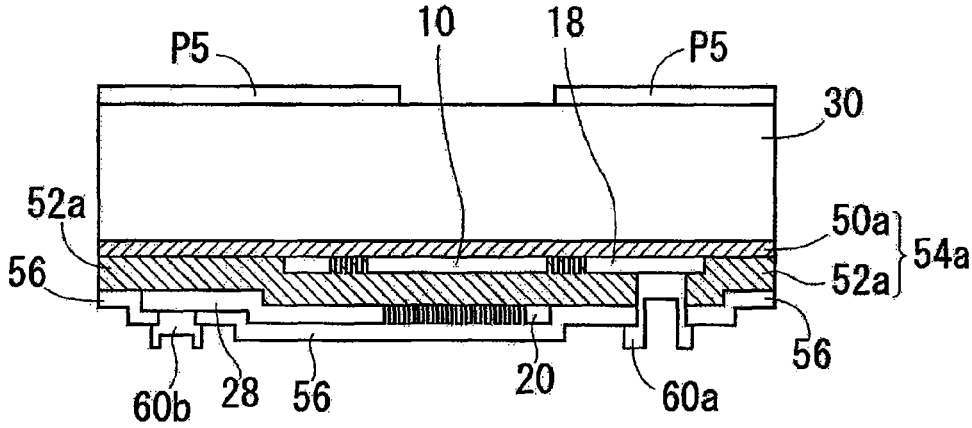
FIG. 23 is a cross-sectional view showing a twentieth step of the manufacturing method of the condenser microphone according to the first embodiment.

Next, as shown in FIG. 22, the second conductive layer 20*a* and the first conductive layer 10*a* positioned at the backside of the substrate 30 are polished and removed by use of a grinder; furthermore, the backside of the substrate 30 is polished so as to adjust the thickness of the substrate 30 within the range of 500 μm to 600 μm. Next, as shown in FIG. 23, a photoresist pattern P5 is formed on the backside of the substrate 30 by way of the photolithography technique. The photoresist pattern P5 has an opening in conformity with the center portion 12 of the diaphragm 10.

Figure 24:
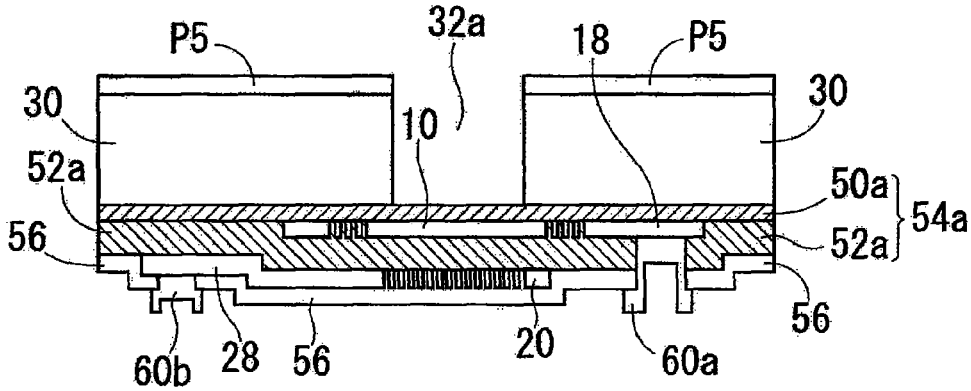
FIG. 24 is a cross-sectional view showing a twenty-first step of the manufacturing method of the condenser microphone according to the first embodiment.
Figure 25:
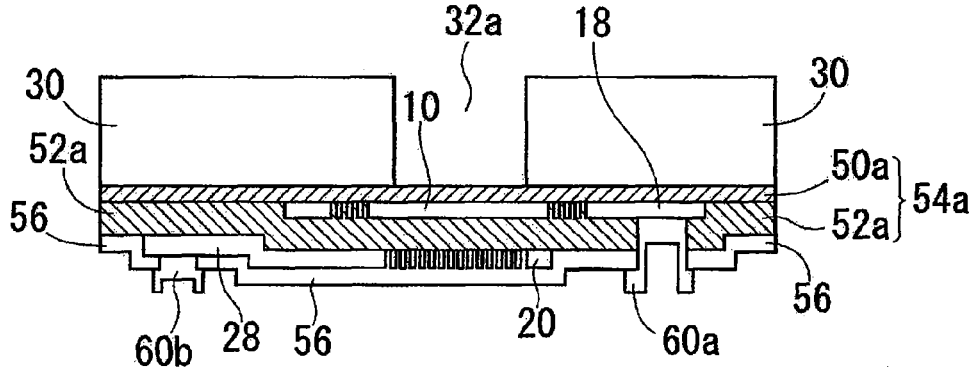
FIG. 25 is a cross-sectional view showing a twenty-second step of the manufacturing method of the condenser microphone according to the first embodiment.

Next, as shown in FIG. 24, anisotropic etching such as Deep RIE is performed by use of the photoresist pattern P5 serving as a mask so as to selectively remove the substrate 30, thus forming an opening 32*a* reaching the first insulating film 50*a*. The opening 32*a* is positioned along the inside of the center portion 12 of the diaphragm 10. Next, as shown in FIG. 25, incineration and dissolution using an organic peeling solution are performed so as to remove the photoresist pattern P5.

Figure 26:
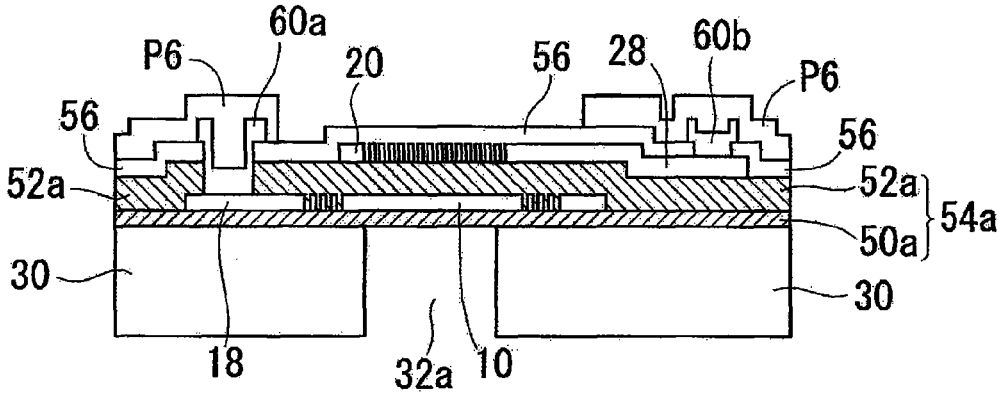
FIG. 26 is a cross-sectional view showing a twenty-third step of the manufacturing method of the condenser microphone according to the first embodiment.

Next, as shown in FIG. 26, a photoresist film is applied to the first electrode 60*a* and the second electrode 60*b* as well as the entire surface of the third insulating film 56; then, a photoresist pattern P6 is formed by way of the photolithography technique. The photoresist pattern P6 covers the first electrode 60*a* and the second electrode 60*b* as well as the third insulating film 56 above the extension wires 18 and 28.

Figure 27:
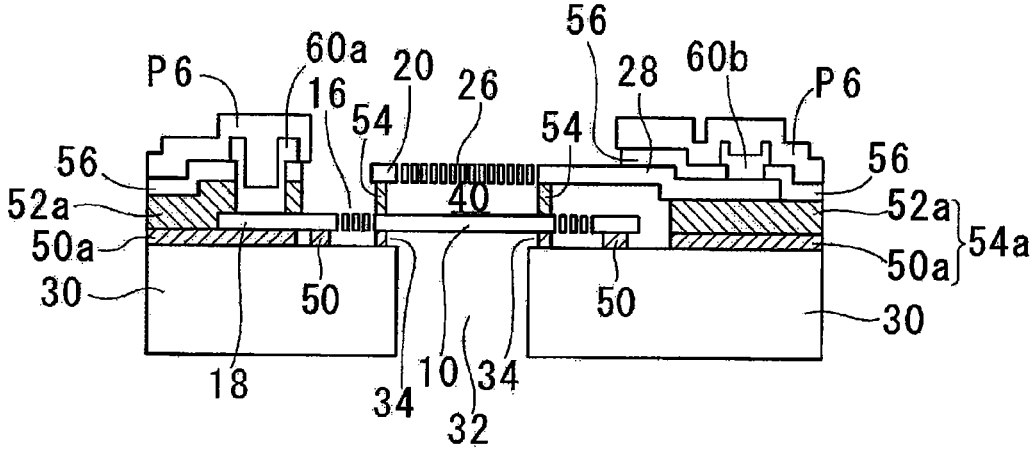
FIG. 27 is a cross-sectional view showing a twenty-fourth step of the manufacturing method of the condenser microphone according to the first embodiment.

Next, as shown in FIG. 27, wet etching using buffered hydrofluoric acid (Buffered HF) is performed by use of the photoresist pattern P6 serving as a mask so as to selectively remove the third insulating film 56, the second insulating film 52*a*, and the first insulating film 50*a*. At this time, a plurality of holes 26 formed in the arms 24 and the center portion 22 of the back plate 20 serve as guide holes for introducing an etching solution when the second insulating film 52*a* intervened between the back plate 20 and the diaphragm 10 is removed. In addition, the buffered hydrofluoric acid is introduced into the opening 32*a* of the substrate 30 so as to selectively remove the first insulating film 50*a* by way of etching.

As described above, the gap 40 is formed by removing the second insulating film 52*a* intervened between the back plate 20 and the diaphragm 10. In addition, by removing the first insulating film 50*a*, the opening 32*a* of the substrate 30 is expanded to reach the diaphragm 10 so as to form the cavity 32, and the passage 34 having a desired acoustic resistance is formed between the substrate 30 surrounding the cavity 32 and the diaphragm 10.

At the same time, the first insulating film 50*a* is intentionally left between the tip ends of the six arms 14 of the diaphragm 10 and the substrate 30, thus forming the first support 50. In addition, the laminated insulating film 54*a* is intentionally left between the tip ends of the six arms 24 of the back plate 20 and the substrate 30, thus forming the second support 54.

Figure 28:
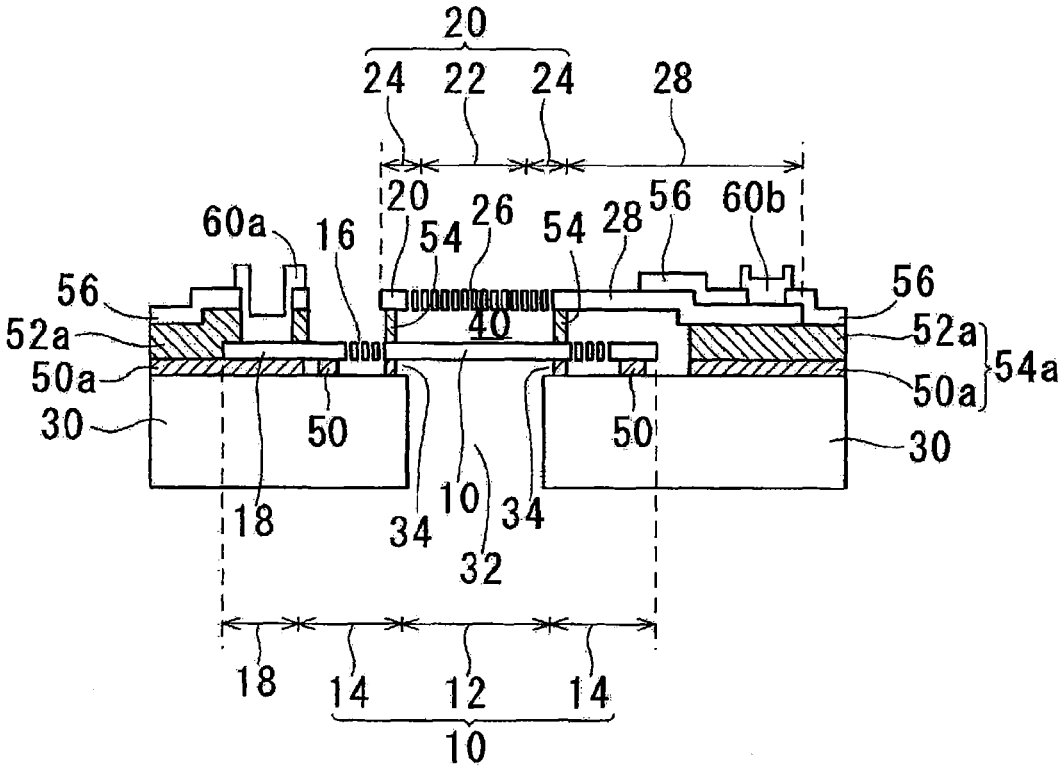
FIG. 28 is a cross-sectional view showing a twenty-fifth step of the manufacturing method of the condenser microphone according to the first embodiment.

Next, as shown in FIG. 28, incineration and dissolution using an organic peeling solution are performed so as to remove the photoresist pattern P6. Thus, it is possible to produce the condenser microphone of the first embodiment having the structure shown in FIGS. 1A, 1B, and 1C.

In the manufacturing method of the condenser microphone of the first embodiment, resist masks having different patterns are used to perform the photolithography multiple times; hence, it is possible to directly adopt the conventionally-known semiconductor manufacturing process. In addition, it does not need the complex process, which is taught in the prior-art technology and in which the rear electrode is arranged on the prescribed portion of the surface of the plate composed of an insulating material positioned opposite to the diaphragm so as to reduce the manufacturing yield; hence, it is possible not to increase the manufacturing cost.

The first embodiment of the present invention is not necessarily limited to the condenser microphone having the structure as shown in FIGS. 1A, 1B, and 1C; hence, it is possible to realize a variety of modifications. Hereinafter, variations will be explained.

(First Variation)

The condenser microphone of the first embodiment is modified such that the back plate 20 is entirely shaped in a disk-like shape, in which the radius thereof is longer than the radius of the center portion 12 of the diaphragm 10 but is shorter than the distance from the center of the center portion 12 of the diaphragm 10 to the tip end of the arm 14.

In the first variation, the diaphragm 10 has a gear-like shape including the center portion 12 and the six arms 14; hence, the back plate 20 does not exist at the positions corresponding to the cutouts formed between the arms 14, so that no parasitic capacitance occurs therebetween. In addition, the arms 14 of the diaphragm 10 are positioned externally of the external periphery of the back plate 20; hence, no parasitic capacitance occur therebetween. Therefore, in the condenser microphone of the first variation compared with the condenser microphone having the conventionally-known structure shown in FIGS. 2A and 2B, it is possible to remarkably reduce the parasitic capacitance.

However, since the inner portions of the arms 14 of the diaphragm 10 are positioned to match the external circumference of the back plate 20 having a disk-like shape, some parasitic capacitance may occur therebetween. That is, the first variation is simple in structure in comparison with the first embodiment, whereas the parasitic capacitance may slightly increase.

(Second Variation)

The condenser microphone of the first embodiment is modified such that the diaphragm 10 is entirely shaped in a disk-like shape. In this case, since the back plate 20 has a gear-like shape including the center portion 22 and the six arms 24, the diaphragm 10 does not exist at the positions corresponding to the cutouts formed between the arms 24; hence, no parasitic capacitance occurs therebetween. Therefore, in the condenser microphone of the second variation compared with the condenser microphone having the conventionally-known structure as shown in FIGS. 2A and 2B, it is possible to reduce the parasitic capacitance. However, since the inner portions of the arms 24 of the back plate 20 are positioned to match the external circumference of the diaphragm 10 having a disk-like shape, some parasitic capacitance may occur therebetween. That is, in the second variation compared with the first embodiment, the parasitic capacitance may slightly increase.

(Third Variation)

The condenser microphone of the first embodiment is modified such that the holes 16 are not formed in the arms 14 of the diaphragm 10, and the cavity 32 is formed along the exterior periphery of the diaphragm 10 having a gear-like shape constituted of the center portion 12 and the arms 14. In this case, the opening of the cavity 32 is formed entirely in conformity with the diaphragm having a gear-like shape except for the tip ends of the arms 14; hence, the volume of the cavity 32 according to the third variation becomes larger than the volume of the cavity 32 according to the first embodiment. Thus, it is possible to further improve the vibration characteristics of the diaphragm 10.

(Fourth Variation)

Figure 35A:
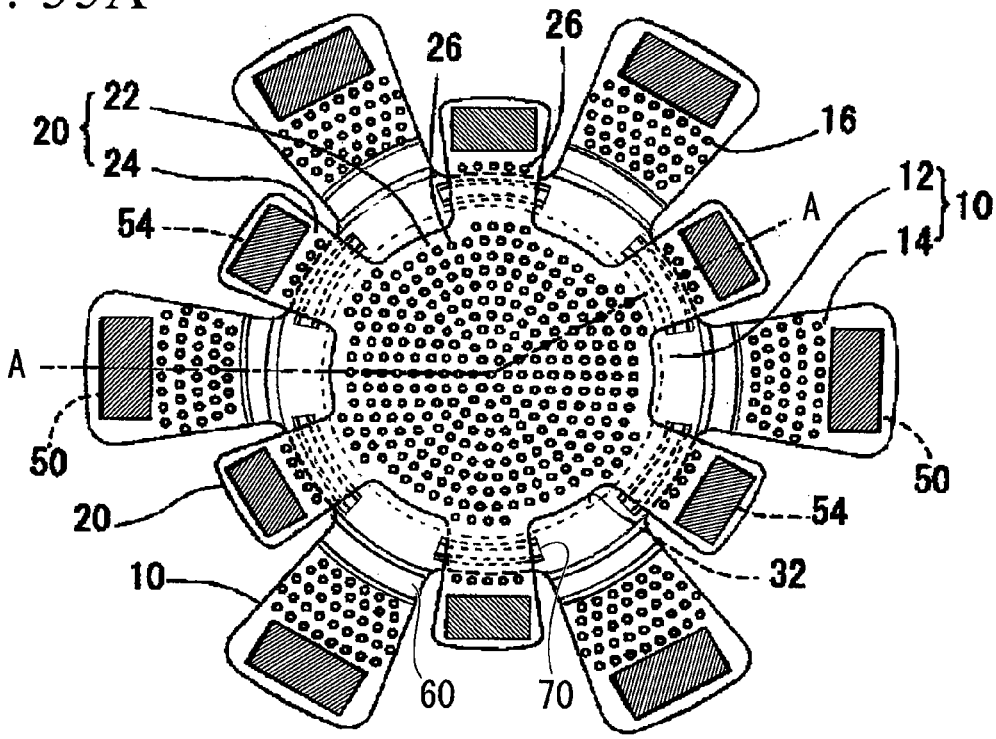
FIG. 35A is a plan view showing the constitution of a condenser microphone in accordance with a fourth variation of the first embodiment of the present invention.
Figure 35B:
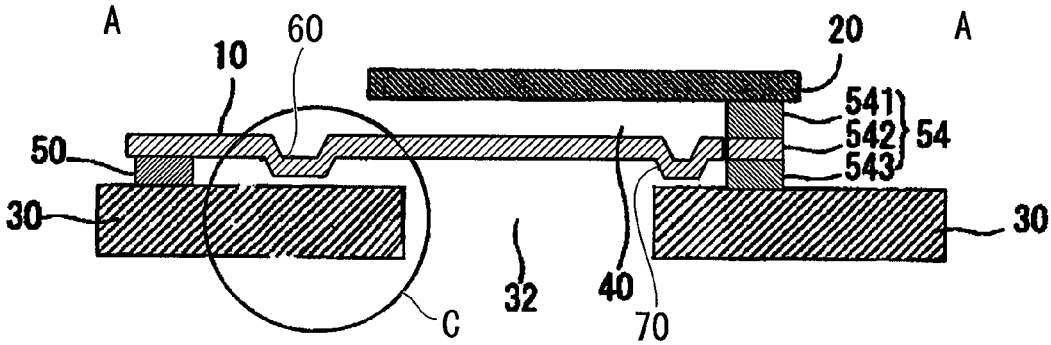
FIG. 35B is a cross-sectional view taken along line A-A in FIG. 35A.
Figure 35C:
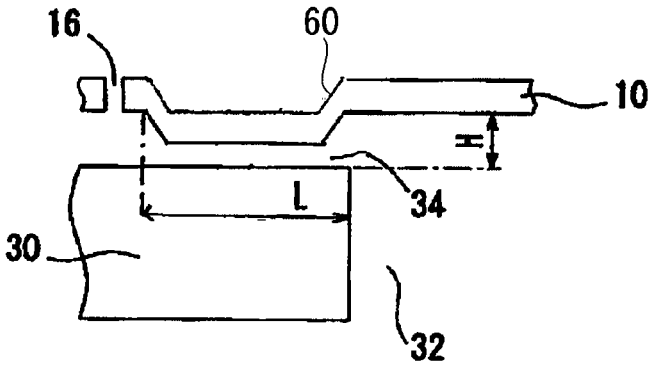
FIG. 35C is a fragmentary enlarged view of FIG. 35B.

A condenser microphone according to a fourth variation of the first embodiment will be described with reference to FIGS. 35A to 35C. FIG. 35A is a plan view showing the constitution of the condenser microphone of the fourth variation; FIG. 35B is a cross-sectional view taken along line A-A in FIG. 35A; and FIG. 35C is a fragmentary enlarged view of FIG. 35B. As shown in FIGS. 35A and 35B, first projections 60 and second projections 70 are formed in the diaphragm 10 in the condenser microphone of the fourth variation. The first projections form step-difference shapes with respect to the arms 14, wherein they are directed toward the substrate 30 so as to further reduce the space corresponding to the passage 34 formed between the diaphragm 10 and the substrate 30 surrounding the cavity 32. The second projections 70 form step-difference shapes at the positions opposite to the arms 24 of the back plate 20, i.e., at the cutouts of the diaphragm 10. The second projections 70 are directed toward the substrate 30 so as to further reduce the space corresponding to the passage 34 formed between the cutout of the diaphragm 10 and the substrate 30 surrounding the cavity 32. By means of the first projections 60 and the second projections 70, it is possible to further reduce the space of the passage 34, wherein since the space forms an acoustic resistance, it is possible to prevent sound waves transmitted to the diaphragm 10 from propagating between the arms 14 and from leaking therefrom. Due to the formation of the first projections 60 and the second projections 70 in the diaphragm 10, it is possible to reduce the rigidity of the diaphragm 10, which makes it possible for the diaphragm 10 to be easily deformed due to sound pressure. Thus, it is possible to further improve the vibration characteristics of the diaphragm 10. Incidentally, the first projections 60 and the second projections 70 form step-difference shapes in the fourth variation; but this is not a restriction; hence, it is possible to form dimples or corrugations projecting toward the substrate 30. Furthermore, the second projections 70 are formed at the positions opposite to the arms 24 of the back plate 20; but this is not a restriction; hence, it is possible to continuously form the second projections 70, i.e., it is possible to form a second projection 70 having a ring shape. In addition, the portions of the first projections 60 and the second projections 70 positioned opposite to the substrate 30 can be formed using insulating materials.

Second Embodiment

Figure 30A:
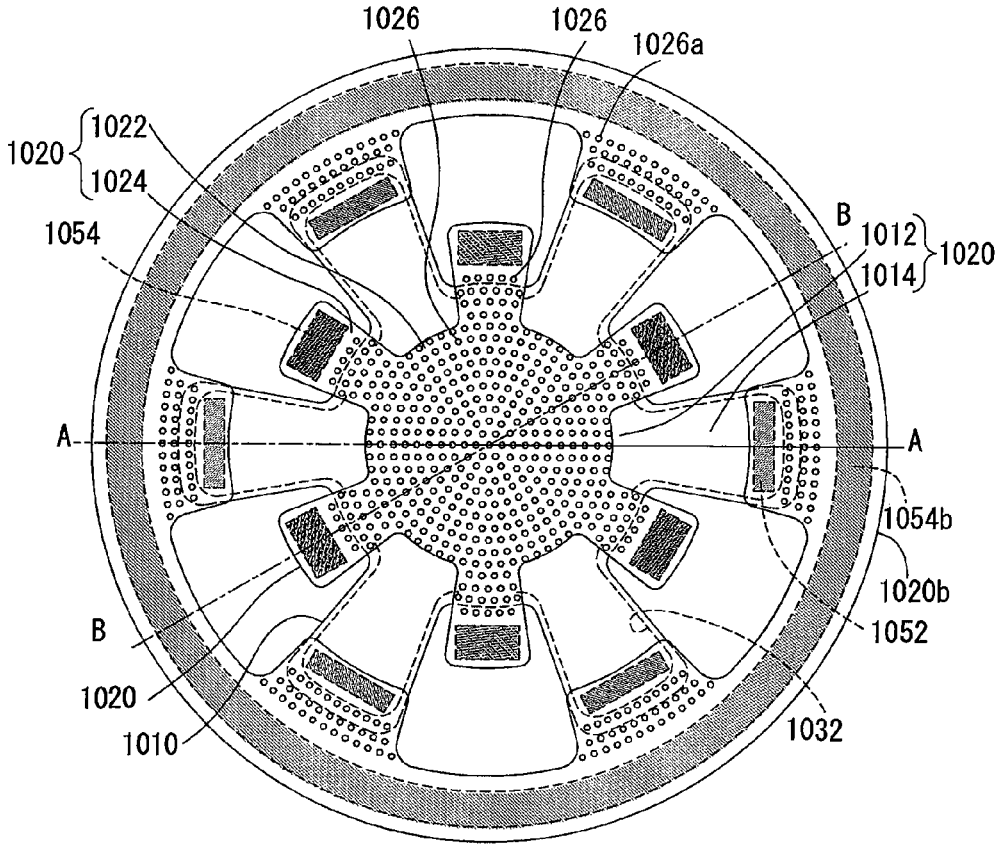
FIG. 30A is a plan view showing the constitution of a condenser microphone in accordance with a second embodiment of the present invention.
Figure 30B:
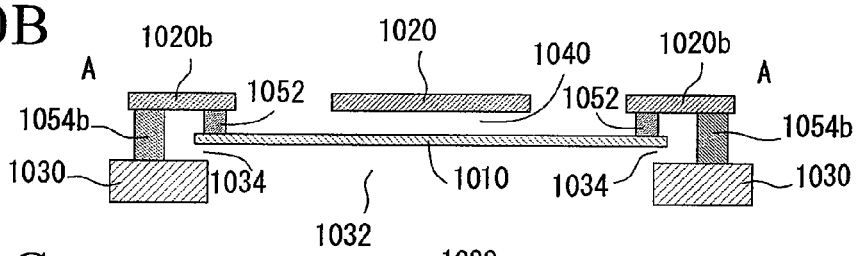
FIG. 30B is a cross-sectional view taken along line A-A in FIG. 30A.
Figure 30C:
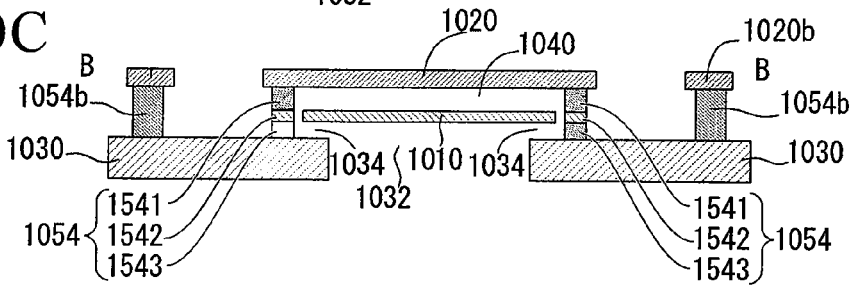
FIG. 30C is a cross-sectional view taken along line B-B in FIG. 30A.

Next, a condenser microphone according to a second embodiment of the present invention will be described with reference to FIGS. 30A, 30B, and 30C. FIG. 30A is a plan view showing the constitution of the condenser microphone of the second embodiment; FIG. 30B is a cross-sectional view taken along line A-A in FIG. 30A; and FIG. 30C is a cross-sectional view taken along line B-B in FIG. 30A.

The condenser microphone of the second embodiment is constituted of a diaphragm 1010, a back plate 1020, and a substrate 1030 having a support member for supporting the diaphragm 1010 and the back plate 1020.

The diaphragm 1010 is a thin film having a conductivity composed of polysilicon, which is added with phosphorus as impurities, wherein it has a gear-like shape including a center portion 1012 having a disk-like shape and six arms 1014 extended externally in a radial manner. The thickness of the diaphragm 1010 is approximately 0.5 μm; the radius of the center portion 1012 is approximately 0.35 mm; and the length of the arm 1014 is approximately 0.15 mm.

The back plate 1020 is arranged in parallel with the diaphragm 1010 with a prescribed distance therebetween, e.g., via a gap 1040 of 0.4 μm therebetween. Similar to the diaphragm 1010, the back plate 1020 is a thin film having a conductivity composed of phosphorus-doped polysilicon, wherein it has a gear-like shape including a center portion 1022 having a disk-like shape and six arms 1024 extended externally in a radial manner. A plurality of holes 1026 are formed in the center portion 1022 and the arms 1024 of the back plate 1020. The holes 1024 of the back plate 1020 function as sound holes by which sound waves from the exterior pass through and are then transmitted to the diaphragm 1010. The thickness of the back plate 1020 is approximately 1.5 μm; the radius of the center portion 1022 is approximately 0.3 mm; and the length of the arm 1024 is approximately 0.1 mm.

The center portion 1022 of the back plate 1020 is arranged concentrically with the diaphragm 1010, wherein the radius of the center portion 1022 of the back plate 1020 is smaller than the radius of the center portion 1012 of the diaphragm 1010. In addition, the six arms 1024 of the back plate 1020 are positioned at the six cutouts formed between the six arms 1014 of the diaphragm 1010. In other words, the six arms 1014 of the diaphragm 1010 are positioned at the six cutouts formed between the six arms 1024 of the back plate 1020. The distance from the center of the center portion 1022 of the back plate 1020 to the tip end of the arm 1024 is longer than the radius of the center portion 1012 of the diaphragm 1010 but is shorter than the distance from the center of the center portion 1012 of the diaphragm 1010 to the tip end of the arm 1014.

The tip ends of the arms 1014 of the diaphragm 1010 join lower surfaces of spacers 1052 having an insulating property. Upper surfaces of the spacers 1052 join the inner end of a bridge 1020*b*. The bridge 1020*b* is a thin film composed of the same material of the back plate 1020, i.e., polysilicon having a conductivity, and is formed simultaneously with the back plate 1020. The outer end of the bridge 1020*b* has a circumferential shape surrounding the external periphery of the diaphragm 1010 having a gear-like shape, wherein it is supported above the substrate 1030 by means of a first support 1054*b* having an insulating property. In the bridge 1020*b*, a plurality of holes 1026*a* are formed in regions defined between the spacers 1052 and the first support 1054*b*. The tip ends of the arms 1024 of the back plate 1020 are supported above the substrate 1030 by means of second supports 1054, each having an insulating property, which are positioned at the cutouts formed between the arms 1014 of the diaphragm 1010. The spacers 1052, the first support 1054*b*, and the second supports 1054 are composed of silicon oxide films, for example.

The second support 1054 for supporting the back plate 1020 is formed using insulating films 1541 and 1543 and a conductive film 1542. The insulating films 1541 and 1543 are composed of silicon oxide films, for example. It is preferable that the conductive film 1542 be formed simultaneously with the diaphragm 1010 and is composed of polysilicon, which is added with phosphorus as impurities. The conductive film 1542 is placed at the same potential as the back plate 1020 or the substrate 1030, wherein it functions as a guard electrode for reducing the parasitic capacitance of the condenser microphone. Incidentally, it is possible to omit the conductive film 1542.

The substrate 1030 is constituted of a silicon substrate whose thickness ranges from 500 μm to 600 μm, wherein a cavity 1032 having an opening reaching the diaphragm 1010 runs through the substrate 1030 in conformity with the diaphragm 1010 having a gear-like shape. The cavity 1032 is formed along the inside of the external periphery of the diaphragm 1010, wherein it functions as pressure relaxation space for relaxing pressure applied to the diaphragm 1010 opposite to the back plate 1020. In addition, a passage 1034 having an acoustic resistance that is higher than the acoustic resistance between the arms 1014 of the diaphragm 1010 is formed between the substrate 1030 surrounding the cavity 1032 and the diaphragm 1010. The acoustic resistance is controlled in response to a height H (i.e., the distance between the diaphragm 1010 and the substrate 1030) and a length L (i.e., the distance from the external periphery of the diaphragm 1010 having a gear-like shape to the end portion of the cavity 1032) of the passage 1034, thus realizing an acoustic resistance that is higher than the acoustic resistance between the arms 1014 of the diaphragm 1010. The passage 1034 having a high acoustic resistance prevents sound waves reaching the diaphragm 1010 from passing between the arms 1014 and from leaking therefrom. Incidentally, the height H of the passage 1034 is approximately 2 and the length L is approximately 15 mm.

Figure 31A:
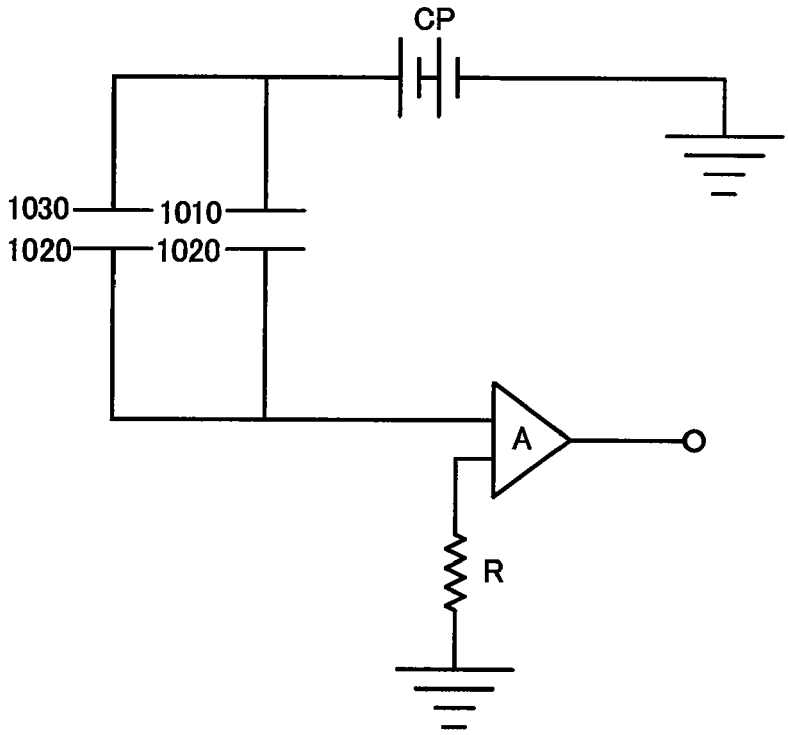
FIG. 31A is a circuit diagram showing the constitution of a detection circuit that converts variations of electrostatic capacitance formed between a diaphragm and a back plate into electric signals.

FIG. 31A is a circuit diagram showing the constitution of a detection circuit for converting variations of electrostatic capacitance between the diaphragm 1010 and the back plate 1020 into electric signals. A stable bias voltage is applied to the diaphragm 1010 by means of a charge pump CP. Variations of electrostatic capacitance between the back plate 1020 and the diaphragm 1010 are input into a pre-amplifier A in the form of voltage variations. Since the substrate 1030 and the diaphragm 1010 are short-circuited, no parasitic capacitance may occur between the back plate 1020 and the substrate 1030 with the intervention of the conductive film 1542 shown in FIG. 30C.

Figure 31B:
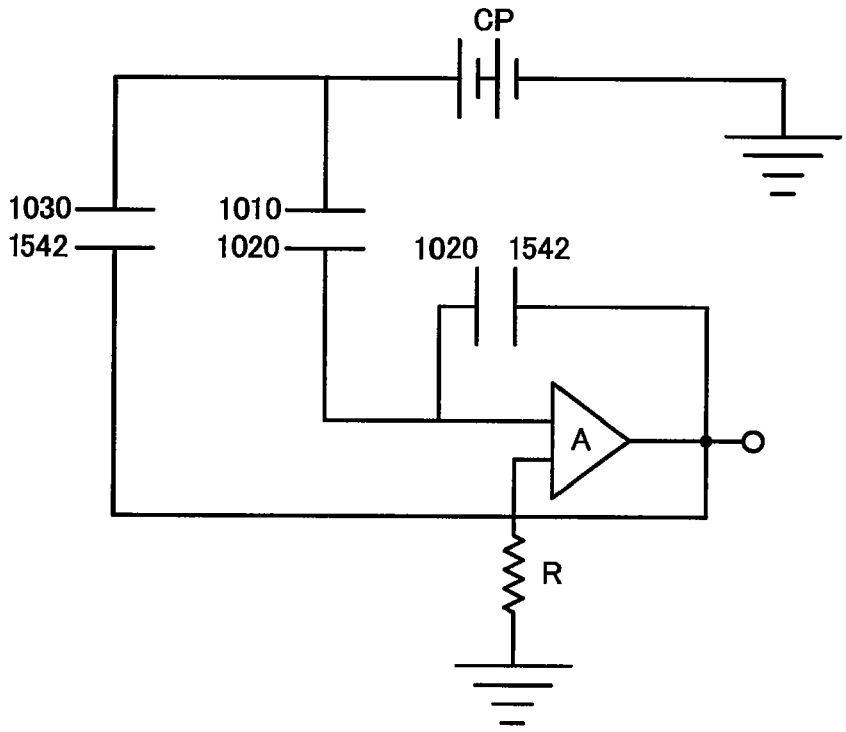
FIG. 31B is a circuit diagram showing the constitution of a detection circuit arranging a conductive film.

FIG. 31B shows the constitution of a detection circuit arranging the conductive film 1542. Herein, an output terminal of the pre-amplifier A is connected to the conductive film 1542 so that a voltage-follower circuit is formed using the pre-amplifier A; this makes it possible for the conductive film 1542 to function as a guard electrode. The back plate 1020 and the conductive film 1542 are controlled at the same potential by means of the voltage-follower circuit, whereby it is possible to eliminate the parasitic capacitance occurring between the back plate 1020 and the conductive film 1542. In addition, the diaphragm 1010 and the substrate 1030 are short-circuited, so that the capacitance between the conductive film 1542 and the substrate 1030 becomes irrelevant to the output of the pre-amplifier A. As described above, the guard electrode is formed using the conductive film 1542 so as to further reduce the parasitic capacitance of the condenser microphone.

In the condenser microphone of the second embodiment, the diaphragm 1010 and the back plate both have the gear-like shapes, wherein the center portion 1012 of the diaphragm 1010 is arranged opposite to the center portion 1022 of the back plate 1020. The six arms 1024 of the back plate 1020 are positioned at the six cutouts formed between the six arms 1014 of the diaphragm 1010; in other words, the six arms 1014 of the diaphragm 1010 are positioned at the cutouts formed between the six arms 1024 of the back plate 1020. For this reason, the arms 1014 of the diaphragm 1010 and the arms 1024 of the back plate 1020 are positionally shifted from each other and are not arranged opposite to each other; therefore, no parasitic capacitance may occur between them. That is, electrostatic capacitance is formed between the center portion 1012 of the diaphragm 1010 and the center portion 1022 of the back plate 1020, whereby electric signals are generated in response to variations of electrostatic capacitance. Since the parasitic capacitance between the diaphragm 1010 and the back plate 1020 is remarkably reduced, it is possible to remarkably increase the sensitivity of the condense microphone.

The tip ends of the arms 1014 of the diaphragm 1010 are supported by means of the spacers 1052, the bridge 1020*b*, and the first support 1054*b*, wherein the distance from the center of the center portion 1012 of the diaphragm 1010 to the spacers 1052 is longer than the distance from the center of the center portion 1022 of the back plate 1020 to the second supports 1054 for supporting the tip ends of the arms 1024. For this reason, in comparison with the structure, in which the external periphery of the diaphragm 1010 is directly supported above the substrate 1030, and the structure, in which the diaphragm 1010 and the back plate 1020 both have the same shape in plan view, the structure of the second embodiment can further improve the vibration characteristics of the diaphragm 1010.

In addition, the radius of the center portion 1022 of the back plate 1020 is smaller than the radius of the center portion 1012 of the diaphragm 1010, and the distance from the center of the center portion 1022 to the second support 1054 is shorter than the distance from the center of the center portion 1012 to the spacer 1054. For this reason, in comparison with the structure, in which both of the diaphragm 1010 and the back plate 1020 have the same shape in plan view, it is possible to increase the rigidity of the back plate 1020; therefore, it is possible to increase the size of the diaphragm 1010 without damaging the operation stability of the condenser microphone, and it is possible to improve the vibration characteristics of the diaphragm 1010.

Since a plurality of holes 1026*a* are formed in the bridge 1020*b*, the rigidity of the bridge 1020*b* joining the arms 1014 of the diaphragm 1010 decreases; this makes it easy for the bridge 1020*b* to be deformed at a vibration mode of the diaphragm 1010; hence, it is possible to further improve the vibration characteristics of the diaphragm 1010.

In order to confirm the effect of the condenser microphone of the second embodiment, the inventor of the present application produced a condenser microphone having the conventionally-known structure shown in FIGS. 2A and 2B and a condenser microphone as shown in FIGS. 3A and 3B for use in experiments, and thus performed experiments. Results of experiments are shown in Table 2.

TABLE 2

| | Electrode pressure resistance | Vibration displacement value | Sensitivity |
|---|---|---|---|
| Conventionally-known structure | 1.0 | 1.0 | 1.0 |
| Experimental structure | 0.8 | — | — |
| Second embodiment | 1.2 | 8.0 | 12.0 |

In the results of experiments regarding the second embodiment shown in Table 2 compared with the first embodiment shown in Table 1, the electrode pressure resistance is increased 1.2 times higher than that of the conventionally-known structure. This is because the second supports 1054 for supporting the tip ends of the arms 1022 of the back plate 1020 are positioned at the cutouts formed between the arms 1014 of the diaphragm 1010; the distance from the center of the center portion 1022 of the back plate 1020 to the second support 1054 is shorter than the distance from the center of the diaphragm 100 to the first support 500 in the conventionally-known structure; and the rigidity of the back plate 1020 is relatively high. Due to the increase of the electrode pressure resistance, it is possible to improve the operation stability of the condenser microphone of the second embodiment.

In the second embodiment, the vibration displacement value of the diaphragm 1010 is increased 8.0 times higher than that of the conventionally-known structure. This is because the tip ends of the arms 1014 of the diaphragm 1010 having a gear-like shape are supported by the spacers 1052 and the bridge 1020*b*. That is, in comparison with the conventionally-known structure in which the overall periphery of the diaphragm 100 is fixed, it is possible to remarkably improve the vibration characteristics of the diaphragm 1010.

In the second embodiment, the sensitivity of the condenser microphone is increased 12.0 times higher than that of the conventionally-known structure. This is because the vibration displacement value of the diaphragm 1010 is remarkably higher than that of the diaphragm 100 of the conventionally-known structure, wherein electrostatic capacitance is formed between the center portion 1012 of the diaphragm 1010 and the center portion 1022 of the back plate 1020, and wherein the arms 1014 and the arms 1024 are not positioned opposite to each other so that no parasitic capacitance occurs therebetween. That is, in the condenser microphone of the second embodiment, it is possible to remarkably reduce the parasitic capacitance.

Next, a manufacturing method of the condenser microphone of the second embodiment will be described. This condenser microphone is a silicon microphone (or a silicon capacitor microphone), which can be manufactured using the semiconductor manufacturing process.

First, a first conductive layer composed of phosphorus-doped polysilicon is formed on the substrate 1030, which is a semiconductor substrate such as a monocrystal silicon substrate, via a first insulating film (or a first sacrifice film) composed of a silicon oxide film. The first conductive layer is subjected to etching and is thus processed into a prescribed shape, thus forming the diaphragm 1010. As shown in FIG. 30A, the diaphragm 1010 has a gear-like shape including the center portion 1012 having a disk-like shape and the six arms 1014 extended externally in a radial manner.

Next, a second conductive layer composed of phosphorus-doped polysilicon is formed on the diaphragm 1010 and the first insulating film via a second insulating film (or a second sacrifice film). The second conductive layer is subjected to etching and is thus processed into a prescribed shape, thus forming the back plate 1020 and the bridge 1020*b*. As shown in FIG. 30A, the back plate 1020 has a gear-like shape including the center portion 1022 having a disk-like shape and the six arms 1024 extended externally in a radial manner, wherein a plurality of holes 1026*a* are formed in the bridge 1020*b*.

As shown in FIG. 30A, the center portion 1022 of the back plate 1020 is arranged concentrically with the center portion 1012 of the diaphragm 1010, wherein the radius of the center portion 1022 of the back plate 1020 is shorter than the radius of the center portion 1012 of the diaphragm 1010. In addition, the six arms 1025 of the back plate 1020 are positioned at the six cutouts formed between the six arms 1014 of the diaphragm 1010. In other words, the six arms 1014 of the diaphragm 1010 are positioned at the six cutouts formed between the six arms 1024 of the back plate 1020. Furthermore, the distance from the center of the center portion 1022 of the back plate 1020 to the tip end of the arm 1024 is shorter than the distance from the center of the center portion 1012 of the diaphragm 1010 to the tip end of the arm 1014.

As shown in FIG. 30A, the inner end of the bridge 1020*b* is positioned to overlap with the tip ends of the arms 1014 of the diaphragm 1010 in plan view, wherein the external end of the bridge 1020*b* has a circumferential shape surrounding the external periphery of the diaphragm 1010 having a gear-like shape.

Next, a third insulating film composed of a silicon oxide film is formed on the back plate 1020, the bridge 1020*b*, and the second insulating film 1052*a*; then, the backside of the substrate 1030 is polished so as to adjust the thickness thereof. Next, anisotropic etching such as Deep RIE is performed so as to selectively remove the substrate 1030, thus forming an opening reaching the first insulating film. This opening is positioned along the inside of the external periphery of the diaphragm 1010 having a gear-like shape.

Next, wet etching using buffered hydrofluoric acid (Buffered HF) is performed by use of a prescribed photoresist pattern serving as a mask, thus selectively remove the third insulating film, the second insulating film, and the first insulting film. At this time, an etching solution is introduced via the holes 1026 formed in the center portion 1022 and the arms 1024 of the back plate 1020 as well as the holes 1026*a* formed in the bridge 1020*b*, thus removing the second insulating film intervened between the back plate 1020 and the diaphragm 1010. In addition, buffered hydrofluoric acid is introduced into the opening of the substrate 1030 so as to selectively remove the first insulating film by way of etching.

As described above, the second insulating film between the back plate 1020 and the diaphragm 1010 is removed so as to form the gap 1040. In addition, the opening of the substrate 1030 is enlarged to reach the diaphragm 1010 by removing the first insulating film, thus forming the cavity 1032. Furthermore, the passage 1034 realizing a desired acoustic resistance is formed between the substrate 1030 surrounding the cavity 1032 and the diaphragm 1010.

At the same time, the second insulating film is intentionally left between the tip ends of the arms 1014 of the diaphragm 1010 and the bridge 1020*b*, thus forming the spacers 1052. In addition, a laminated insulating film composed of the first insulating film and the second insulating film is intentionally left between the bridge 1020*b* and the substrate 1030, thus forming the first support 1054*b*. Furthermore, the laminated insulating film is intentionally left between the tip ends of the arms 1024 of the back plate 1020 and the substrate 1030, thus forming the second supports 1054.

According to the aforementioned manufacturing method, it is possible to produce the condenser microphone of the second embodiment shown in FIGS. 30A, 30B, and 30C. In this manufacturing method, resist masks having different patterns are used in the photolithography, whereas it is possible to directly use the conventionally-known semiconductor manufacturing process.

Incidentally, the structure of the condenser microphone of the second embodiment is not necessarily limited to the structure shown in FIGS. 30A, 30B, and 30C; hence, it is possible to realize a variety of modifications. For example, the back plate 1020 is entirely formed in a disk-like shape, in which the radius thereof is longer than the radius of the center portion 1012 of the diaphragm 1010 but is shorter than the distance from the center of the center portion 1012 of the diaphragm 1010 to the inner end of the bridge 1020*b*.

In the aforementioned variation in which the diaphragm 1010 has a gear-like shape including the center portion 1012 and the six arms 1014, the diaphragm 1010 is not positioned opposite to the external periphery of the back plate 1020 at the cutouts formed between the arms 1014; hence, no parasitic capacitance occurs therebetween. No parasitic capacitance occurs with respect to the outer portions of the arms 1014 of the diaphragm 1010, which are positioned externally of the external periphery of the back plate 1020, as well. That is, it is possible to reduce the parasitic capacitance in the variation compared with the conventionally-known structure shown in FIGS. 2A and 2B.

However, since the inner portions of the arms 1014 of the diaphragm 1010 are positioned opposite to the external periphery of the back plate 1020 having a disk-like shape, some parasitic capacitance may occur therebetween. For this reason, the parasitic capacitance may be slightly increased in the variation compared with the second embodiment.

Third Embodiment

Figure 32A:
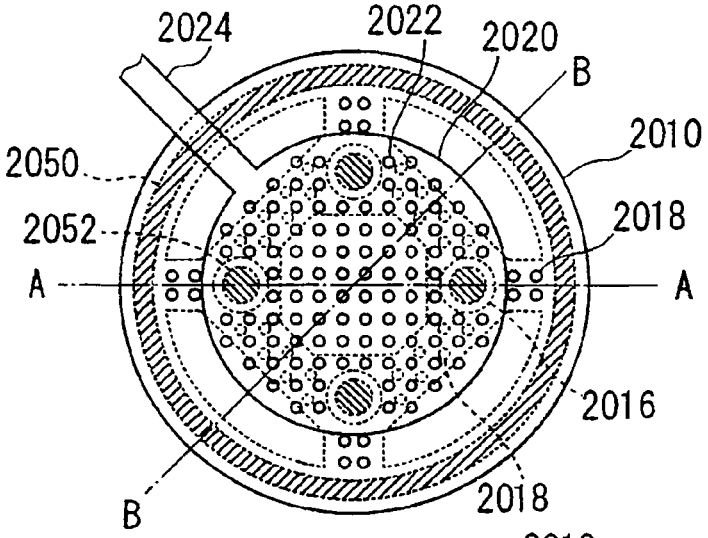
FIG. 32A is a plan view showing the constitution of a condenser microphone in accordance with a third embodiment of the present invention.
Figure 32B:
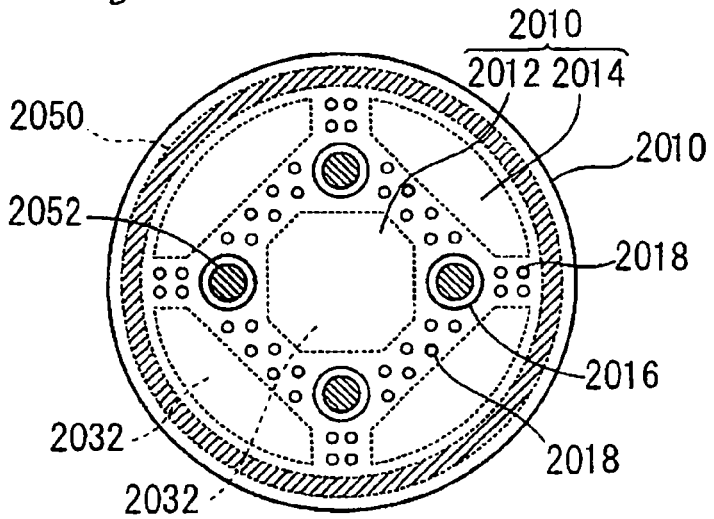
FIG. 32B is a plan view showing the constitution in which the back plate is removed from the constitution shown in FIG. 32A.
Figure 32C:
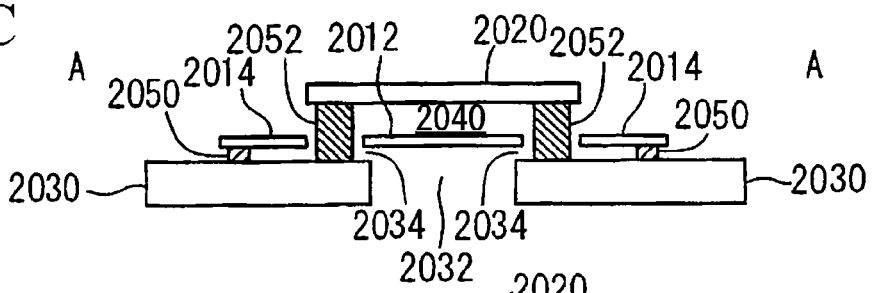
FIG. 32C is a cross-sectional view taken along line A-A in FIG. 32A.
Figure 32D:
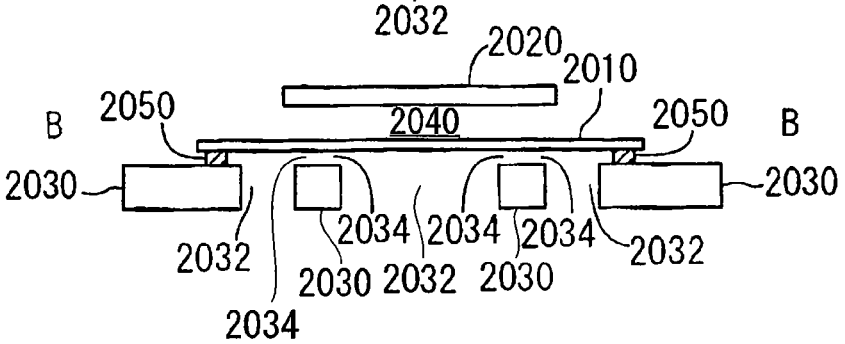
FIG. 32D is a cross-sectional view taken along line B-B in FIG. 32A.

Next, the constitution of a condenser microphone according to a third embodiment of the present invention will be described with reference to FIGS. 32A, 32B, and 32C. FIG. 32A is a cross-sectional view showing the constitution of the condenser microphone of the third embodiment; FIG. 32B is a plan view showing the constitution excluding the back plate from the constitution shown in FIG. 32A; FIG. 32C is a cross-sectional view taken along line A-A in FIG. 32A; and FIG. 32D is a cross-sectional view taken along line B-B in FIG. 32A.

As shown in FIGS. 32A to 32D, the condenser microphone of the third embodiment is constituted of a diaphragm 2010 and a back plate 2020, which are positioned opposite to each other, as well as a substrate 2030 having a support member for supporting the diaphragm 2010 and the back plate 2020 to be insulated from each other.

The diaphragm 2010 is a conductive thin film composed of polysilicon that is added with phosphorus as impurities, wherein it is constituted of a center portion 2012 having a disk-like shape and a peripheral portion 2014 surrounding it. In the center portion 2012 of the diaphragm 2010, four circular holes 2016 are formed in a circumferential direction with equal spacing therebetween in a region adjoining the peripheral portion 2014 (hereinafter, referred to as "an intermediate region"), and a plurality of small holes 2018 are formed therein. In addition, a plurality of small holes 2018 are formed in four regions, which are formed in a circumferential direction with equal spacing therebetween in conformity with the four holes 2016 in the peripheral portion 2014 of the diaphragm 2010. The regions in which the four holes 2016 and the plurality of small holes 2018 are formed in the diaphragm 2010 are arranged in correspondence with the substrate 2030. The thickness of the diaphragm 2010 is approximately 0.5

μm; the radius of the center portion 2012 is approximately 0.35 mm; the overall radius of the diaphragm 2010 including the peripheral portion 2014 is approximately 0.5 mm; and the radius of each hole 2016 is approximately 25 μm.

The back plate 2020 is arranged in parallel with the diaphragm 2010 with a prescribed distance, e.g., a gap 2040 of 4 μm, therebetween. The back plate 2020 is a conductive thin film composed of phosphorus-doped polysilicon, wherein it has a disk-like shape of approximately 2 μm thickness. The back plate 2020 is arranged concentrically with the diaphragm 2010, wherein the radius of the back plate 2020 is substantially identical to the radius of the diaphragm 2010. For this reason, the back plate 2020 is arranged opposite to the diaphragm 2010, while the peripheral portion 2014 is extended outside of the back plate 2020 in plan view. A plurality of small holes 2022 serving as sound holes for transmitting sound waves from the exterior therethrough and for making them reach the diaphragm 2010 are formed in the back plate 2020. Herein, the plurality of small holes 2022 of the back plate 2020 are aligned not to overlap with the plurality of small holes 2018 of the diaphragm 2010 in plan view. In addition, an extension wire 2024 connected to an electrode (not shown) is extended from the external periphery of the back plate 2020.

The external periphery of the peripheral portion 2014 of the diaphragm 2010 is supported in a circumferential manner above the substrate 2030 by means of a first support 2050 having an insulating property. The back plate 2020 is supported above the substrate 2030 by means of four cylindrical second supports 2052 having insulating properties, which are inserted into the four holes 2016 of the diaphragm 2010. The first support and the second supports are composed of silicon oxide films, for example.

The substrate 2030 is a silicon substrate whose thickness ranges from 500 μm to 600 μm, wherein it has an opening running through the substrate 2030 to reach the diaphragm 2010 at a position corresponding to a region (hereinafter, referred to as "a central region") surrounding by the intermediate region in the center portion 2012 of the diaphragm 2010. It also has an opening running through the substrate 2030 to reach the diaphragm 2010 at a position at which none of the small holes 2018 is formed in the peripheral portion 2014 of the diaphragm 2010. A cavity 2032 is formed by means of the aforementioned openings. The cavity 2032 functions as a pressure relaxation room for relaxing pressure applied to the diaphragm 2010 oppositely to the back plate 2020.

A passage 2034 realizing a prescribed acoustic resistance is formed between the substrate 2030 surrounding the cavity 2032 and the diaphragm 2010. The acoustic resistance is controlled by way of a height H (i.e., the distance between the diaphragm 2010 and the substrate 2030) and a length L (i.e., the shortest distance among distances from the four holes 2016 and the plurality of small holes 2018 of the diaphragm 2010 to the end portion of the cavity 2032) of the passage 2034, thus making the center portion 2012 efficiently vibrate due to sound waves reaching the diaphragm 2010. Incidentally, the height of the passage 2034 is 2 μm, and the length is 15 μm.

Other than the aforementioned constituent members, the condenser microphone of the third embodiment includes an extension wire extended from the external periphery of the diaphragm 2010, an electrode connected to the extension wire, an electrode connected to the extension wire 2024 of the back plate 2020, a bias voltage circuit for applying a prescribed voltage between the diaphragm 2020 and the back plate 2020 via these electrodes, and a detection circuit for converting variations of electrostatic capacitance formed between the diaphragm 2010 and the back plate 2020, which are applied with the prescribed voltage, into electric signals. For the sake of convenience, their illustrations and explanations are omitted.

In the condenser microphone of the third embodiment, the back plate 2020 is downsized to match the size of the center portion 2012 of the diaphragm 2010; hence, it is possible to increase the mechanical strength of the back plate 2020 in comparison with the conventionally-known structure in which both of the back plate and diaphragm have substantially the same size. Therefore, even when a voltage applied between the diaphragm 2010 and the back plate 2020 is increased for the purpose of the improvement of the sensitivity of the condenser microphone, it is possible to suppress the deformation of the back plate 2020 due to the electrostatic attraction between the opposite electrodes, and it is possible to prevent the back plate 2020 from being deformed due to an impact from the exterior. That is, it is possible to improve the vibration characteristics of the diaphragm 2010, and it is possible to secure the operation stability of the condenser microphone.

Since the back plate 2020 is directly supported above the substrate 2030 by means of the four second supports 2052, it is possible to maintain the stability of the back plate 2020. That is, it is possible to suppress the deformation of the back plate 2020; it is possible to improve the vibration characteristics; thus, it is possible to secure the operation stability of the condenser microphone.

Although the back plate 2020 is positioned opposite to the center portion 2012 of the diaphragm 2010, it is not positioned opposite to the peripheral portion 2014 of the diaphragm 2010 existing externally of the back plate 2020 in plan view. For this reason, no parasitic capacitance occurs between the peripheral portion 2014 of the diaphragm 2010 and the back plate 2020. That is, compared with the conventionally-known structure in which the back plate and the diaphragm are entirely positioned opposite to each other, the condenser microphone of the third embodiment can remarkably reduce the parasitic capacitance, thus improving the sensitivity.

The four holes 2016 are formed in the intermediate region of the center portion 2012 of the diaphragm 2010, and a plurality of holes 2018 are formed in the periphery. This reduces the rigidity of the diaphragm 2010 so as to realize deformation in a vibration mode with ease, whereby it is possible to increase the displacement of the diaphragm 2010. Thus, it is possible to improve the vibration characteristics of the diaphragm 2010, thus improving the sensitivity of the condenser microphone.

The passage 2034 is formed between the substrate 2030 surrounding the cavity 2032 and the diaphragm 2010, whereby the acoustic resistance is controlled by appropriately setting the height H and the length L of the passage 2034. This makes it possible for the center portion 2012 to efficiently vibrate due to sound waves transmitted to the diaphragm 2010 via a desired acoustic resistance; hence, it is possible to remarkably improve the vibration characteristics of the diaphragm 2010, thus improving the sensitivity of the condenser microphone. Incidentally, the four holes 2016 and the plurality of small holes 2018 are limitedly formed in the regions of the diaphragm 2010 directly facing the substrate 2030, wherein they are not formed in the region directly facing the cavity 2032. For this reason, sound waves reaching the diaphragm 2010 do not cause vibration energy; hence, it is possible to prevent sound waves from passing through the holes 2016 or the small holes 2018.

Since both of the diaphragm 2010 and the back plate 2020 are formed using conductive materials, it is not necessary to perform a complex manufacturing process, in which, as similar to the prior-art technology, a rear electrode facing the diaphragm is formed in the prescribed portion of the back plate composed of an insulating material; this makes it possible to simplify the manufacturing process of the condenser microphone.

In addition, an etching solution is transmitted through the plurality of small holes 2018 formed in the diaphragm 2010 so as to remove the sacrifice layer intervened between the diaphragm 2010 and the substrate 2030 by way of etching, thus forming a gap therebetween. Furthermore, the etching solution is transmitted through the plurality of small holes 2022 formed in the back plate 2020 so as to remove the sacrifice layer intervened between the back plate 2020 and the diaphragm 2010 by way of etching, thus forming an air gap therebetween. Thus, it is possible to simplify the manufacturing process.

In the condenser microphone of the third embodiment, the back plate 2020 is supported above the substrate 2030 by means of the four second supports 2052, whereas the number of the second supports 2052 is not necessarily limited to four. For example, it is possible to support the back plate 2020 in a stable manner by means of three supports 2052. In this case, it is necessary to form three circular holes 2016 in the diaphragm 2010.

The condenser microphone of the third embodiment employs the structure in which the external periphery of the peripheral portion 2014 of the diaphragm 2010 is supported in a circumferential manner above the substrate 2030 by means of the first support 2050; however, the support structure of the diaphragm 2010 is not necessarily limited to this structure; hence, it is possible to employ a variety of support structures. For example, the external periphery of the peripheral portion 2014 of the diaphragm 2010 is not supported continuously in a circumferential manner, but it is supported locally at a plurality of positions above the substrate 2030. Alternatively, the diaphragm 2010 can be supported by means of a bridge supported by the substrate 2030 via a spacer; furthermore, the diaphragm 2010 can be supported by means of arms extended externally from the external periphery of the back plate 2020 via a spacer. That is, within the range not disturbing the structure in which the back plate 2020 is supported above the substrate 2030 by means of the second supports 2052 inserted into a plurality of holes 2016 formed in the diaphragm 2010, it is possible to realize a variety of modifications for the purpose of stress relaxation and for the purpose of the improvement of vibration characteristics with respect to the support structure of the diaphragm 2010.

Next, a manufacturing method of the condenser microphone of the third embodiment will be described. Incidentally, the condenser microphone of the third embodiment is a silicon microphone that is manufactured by way of the semiconductor manufacturing process.

First, a first conductive layer composed of phosphorus-doped polysilicon is formed on the substrate 2030, which is constituted of a monocrystal silicon substrate, via a first insulating film (or a first sacrifice film) composed of a silicon oxide film. The first conductive layer is processed into a prescribed shape by way of etching, thus forming the diaphragm 2010 and its extension wire. As shown in FIG. 30(B), the diaphragm 2010 has the center portion 2012 having a disk-like shape and the peripheral portion 2014 formed in its surrounding. The four circular holes 2016 are formed in a circumferential manner with equal spacing therebetween in the intermediate region of the center portion 2012 of the diaphragm 2010, in which a plurality of small holes 2018 are formed as well. A plurality of small holes 2018 are formed in the four regions in correspondence with the four holes 2016 within the peripheral portion 2014 of the diaphragm 2010. In addition, an extension wire connected to an electrode (not shown) is extended from the external periphery of the diaphragm 2010.

Next, a second conductive layer composed of phosphorus-doped polysilicon is formed on the diaphragm 2010 and the first insulating film via a second insulating film (or a second sacrifice film) composed of a silicon oxide film. The second conductive layer is processed into a prescribed shape by way of etching, thus forming the back plate 2020 and the extension wire 2024. As shown in FIG. 32A, the back plate 2020 has a disk-like shape and is arranged concentrically with the diaphragm 2010, wherein the radius thereof is substantially identical to the radius of the center portion 2012 of the diaphragm 2010. A plurality of small holes 2022 serving as sound holes, which transmit sound waves from the exterior therethrough so that sound waves reach the diaphragm 2010, are formed in the back plate 2020. Furthermore, the extension wire 2024 connected to an electrode (not shown) is extended from the external periphery of the back plate 2020.

Next, a third insulating film composed of a silicon oxide film is formed on the back plate 2020 and the second insulating film; then, the backside of the substrate 2030 is polished so as to adjust the thickness thereof. Subsequently, anisotropic etching such as Deep RIE is performed so as to selectively remove the substrate 2030, thus forming an opening reaching the first insulating film. The opening is formed in conformity with the central region of the center portion 2012 of the diaphragm 2010 and the region in which none of the small holes 2018 is formed in the peripheral portion 2014.

Next, wet etching using buffered hydrofluoric acid (Buffered HF) is performed by use of a prescribed photoresist pattern serving as a mask, thus selectively removing the third insulating film, the second insulating film, and the first insulating film. In addition, an etching solution is infiltrated into a plurality of small holes 2022 formed in the back plate 2020, thus removing the second insulating film intervened between the back plate 2020 and the diaphragm 2010. The etching solution is infiltrated into the four holes 2016 and a plurality of small holes 2018 formed in the diaphragm 2010, thus removing the first insulating film intervened between the diaphragm 2010 and the substrate 2030. Furthermore, buffered hydrofluoric acid is infiltrated into the opening of the substrate 2030, thus selectively removing the first insulating film.

As described above, the second insulating film intervened between the back plate 2020 and the diaphragm 2010 is removed so as to form the gap 2040. Due to the removal of the first insulating film, the opening of the substrate 2030 is enlarged to reach the diaphragm 2010 so as to form the cavity 2032 and to form the passage 2034 realizing a desired acoustic resistance between the substrate 2030 surrounding the cavity 2032 and the diaphragm 2010.

At the same time, the first insulating film is intentionally left between the diaphragm 2010 and the substrate 2030 so as to form the first support 2050. In addition, a laminated insulating film composed of the first insulating film and the second insulating film is left between the back plate 2020 and the substrate 2030, thus forming the second supports 2052 inserted into the four holes 2016 of the diaphragm 2010.

By way of the aforementioned process, it is possible to produce the condenser microphone of the third embodiment shown in FIGS. 32A to 32D.

As described above, it is possible for the manufacturing method of the condenser microphone of the third embodiment to directly use the conventionally-known semiconductor manufacturing process except for the use of resist masks having different patterns in the photolithography.

The third embodiment of the present invention is not necessarily limited to the constitution shown in FIGS. 32A to 32D; hence, it is possible to realize a variety of modifications. Hereinafter, variations will be described.

(First Variation)

Figure 33A:
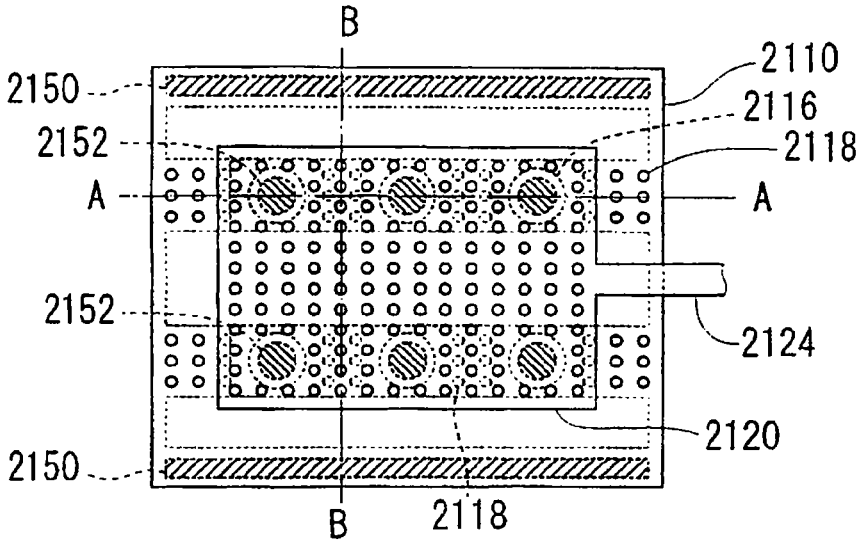
FIG. 33A is a plan view showing the constitution of a condenser microphone in accordance with a first variation of the third embodiment.
Figure 33B:
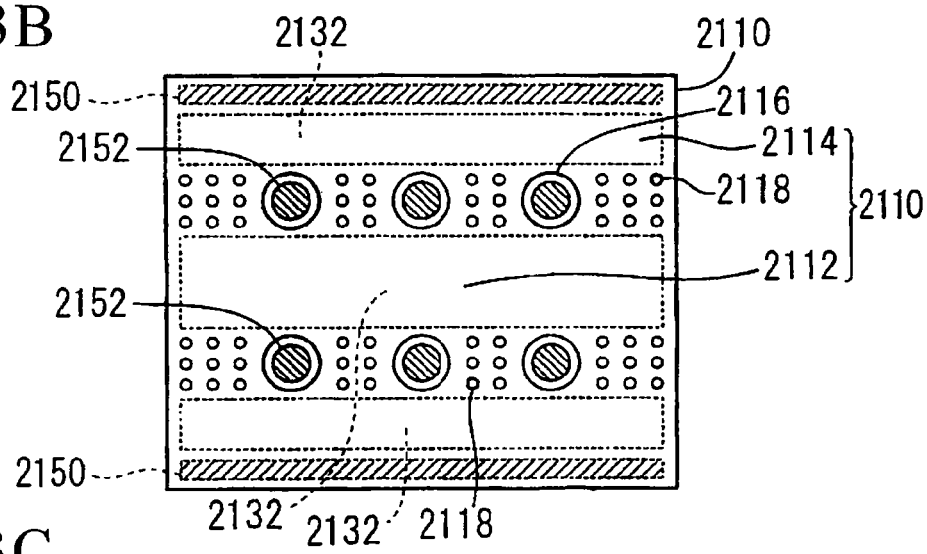
FIG. 33B is a plan view showing the constitution in which the back plate is removed from the constitution shown in FIG. 33A.
Figure 33C:
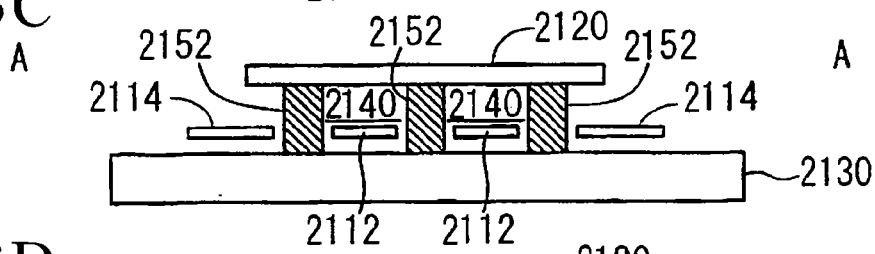
FIG. 33C is a cross-sectional view taken along line A-A in FIG. 33A.
Figure 33D:
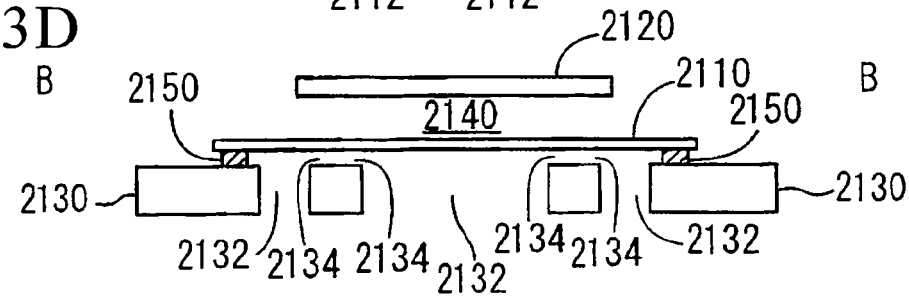
FIG. 33D is a cross-sectional view taken along line B-B in FIG. 33A.

A first variation of the third embodiment will be described with reference to FIGS. 33A to 33D. FIG. 33A is a plan view showing the constitution of a condenser microphone according to a first variation; FIG. 33B is a plan view showing the constitution in which a back plate is excluded from the constitution shown in FIG. 33A; FIG. 33C is a cross-sectional view taken along line A-A in FIG. 33A; and FIG. 33D is a cross-sectional view taken along line B-B in FIG. 33A. The structure of the condenser microphone shown in FIGS. 33A to 33D is substantially identical to the constitution of the condenser microphone shown in FIGS. 32A to 32D; hence, the following description explains only the difference between them.

The condenser microphone of the first variation provides a diaphragm 2110, which does not have a disk-like shape but is entirely formed in a rectangular shape in plan view and which is constituted of a center portion 2112 having a rectangular shape and peripheral portions 2114. Three circular holes 2116 are arranged with equal spacing therebetween and are formed in each of two regions, which lie along opposite long sides and adjoin the peripheral portions, in the center portion 2112 of the diaphragm 2110, wherein a plurality of small holes 2118 are formed as well. In addition, a plurality of small holes 2118 are formed in four regions, which lie along opposite short sides and adjoin the holes 116, in the peripheral portions 2114 of the diaphragm 2110 as well. The regions, in which in total six holes 2116 and plural small holes 2118 are formed, are positioned opposite to the substrate 2130.

Aback plate 2120 is arranged in parallel with the diaphragm 2110 with a gap 2140 therebetween. Similar to the diaphragm 2110, the back plate 2120 has a rectangular shape in plan view, wherein it is positioned opposite to the center portion 2112 of the diaphragm 2110. In plan view, the peripheral portions 2114 of the diaphragm 2110 extend externally of the back plate 2120. A plurality of small holes 2122 serving as sound holes are formed in the back plate 2120. An extension wire 2124 connected to an electrode (not shown) is extended from the external periphery of the back plate 2120.

External peripheries along the opposite long sides in the peripheral portions 2114 of the diaphragm 2110 are supported above the substrate 2130 by means of first supports 2150 having insulating property. In addition, the back plate 2120 is supported above the substrate 2130 by means of six cylindrical second supports 2152 having insulating property, which are inserted into the six holes 2116 of the diaphragm 2110.

An opening, which runs through the substrate 2130 to reach the diaphragm 2110, is formed in conformity with the center portion 2112 of the diaphragm and the regions of the peripheral portions 2114, in which none of the six holes 2116 and none of the small holes 2118 are formed, thus forming a cavity 2132. A passage 2134 realizing a desired acoustic resistance is formed between the substrate 2130 surrounding the cavity 2132 and the diaphragm 2110.

The manufacturing method of the condenser microphone of the first variation is substantially identical to the aforementioned manufacturing method except for the use of resist masks having different patterns in the photolithography; hence, the description thereof will be omitted.

In the condenser microphone of the first variation, the back plate 2120 is supported above the substrate 2130 by means of the second supports 2152 inserted into the holes 2116 of the diaphragm 2110 and is positioned opposite to the center portion 2112 of the diaphragm 2110; however, it is not positioned opposite to the peripheral portions 2114. That is, the condenser microphone of the first variation shown in FIG. 31 is similar to the condenser microphone shown in FIG. 32 in terms of the basic features thereof except that the diaphragm 2110 and the back plate 2120 each have rectangular shapes; hence, it demonstrates similar effects.

In the condenser microphone of the first variation, the back plate 2120 is supported above the substrate 2130 by means of the six second supports 2152; hence, in comparison with the condenser microphone shown in FIG. 32, the back plate 2120 is held in a more stable manner and is more difficult to be deformed. Thus, it is possible to further improve the operation stability of the condenser microphone. That is, it is possible for the condenser microphone of the first variation to further improve the sensitivity by increasing the dimensions thereof.

Furthermore, the external peripheries lying along the long sides of the peripheral portions 2114 of the diaphragm 2110 are supported above the substrate 2130 by means of the first supports 2150. That is, compared with the condenser microphone shown in FIG. 30 in which the external periphery of the peripheral portion 2014 of the diaphragm 2010 is supported in a circumferential manner above the substrate 2030 by means of the first support 2150, the condenser microphone shown in FIG. 33 is further improved in terms of the vibration characteristics of the diaphragm 2110; hence, it is possible to further improve the sensitivity.

In the condenser microphone of the first variation, the back plate 2120 is supported above the substrate 2130 by means of a plurality of second supports 2152, wherein the number of the second supports 2152 is not necessarily limited to six. For example, it is possible to further add two second supports 2152 lying along the opposite short sides of the back plate 2120, so that in total eight second supports 2152 are arranged. In this case, it is necessary to increase the number of the holes 2116 formed in the diaphragm 2110 to eight, and it is necessary to modify the position of the opening forming the cavity 2132 in the substrate 2130. By increasing the number of the second supports 2152, it is possible to hold the back plate 2120 in a stable manner, thus suppressing the deformation thereof. Thus, it is possible to improve the sensitivity by increasing the dimensions of the condenser microphone.

(Second Variation)

Figure 34A:
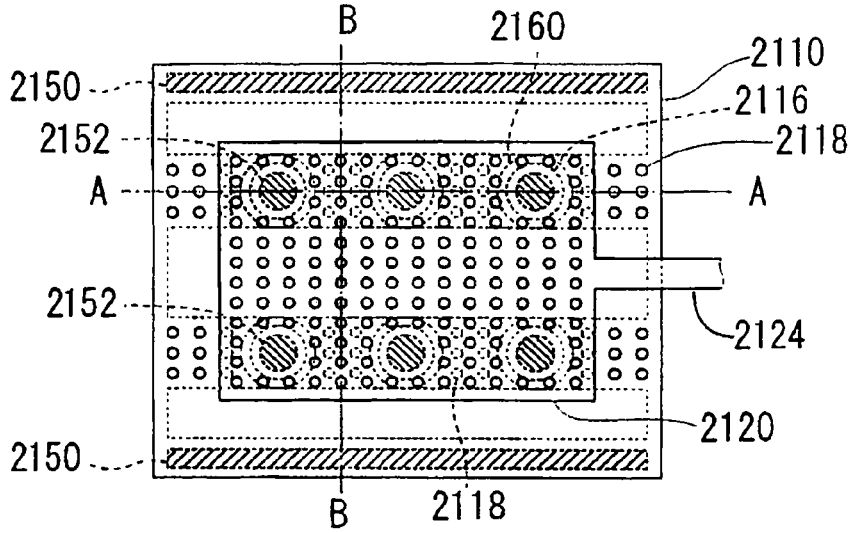
FIG. 34A is a plan view showing the constitution of a condenser microphone in accordance with a second variation of the third embodiment.
Figure 34B:
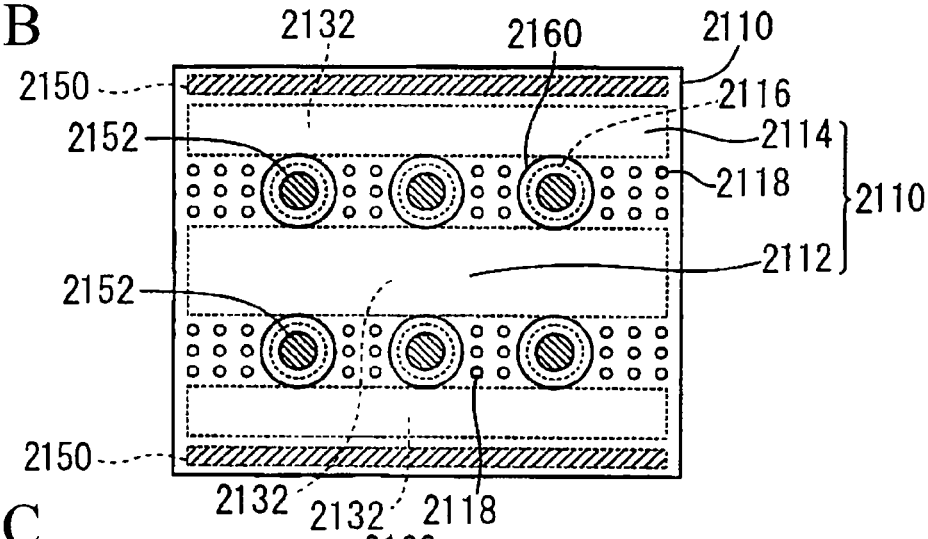
FIG. 34B is a plan view showing the constitution in which the back plate is removed from the constitution shown in FIG. 34A.
Figure 34C:
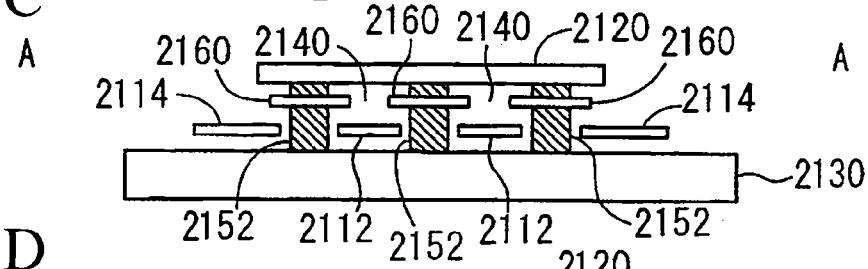
FIG. 34C is a cross-sectional view taken along line A-A in FIG. 34A.
Figure 34D:
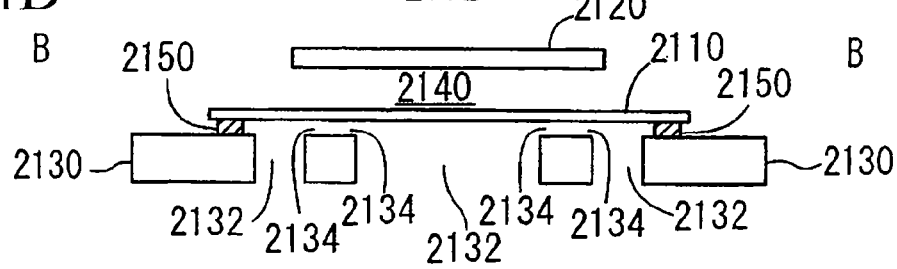
FIG. 34D is a cross-sectional view taken along line B-B in FIG. 34A.

A condenser microphone according to a second variation of the third embodiment will be described with reference to FIGS. 34A to 34D. FIG. 34A is a plan view showing the constitution of the condenser microphone of the second variation; FIG. 34B is a plan view showing the constitution in which a back plate is removed from the constitution shown in FIG. 34A; FIG. 34C is a cross-sectional view taken along line A-A in FIG. 34; and FIG. 34D is a cross-sectional view taken along line B-B in FIG. 34A.

As shown in FIGS. 34A to 34D, the condenser microphone of the second variation has the constitution substantially similar to the constitution of the condenser microphone of the first variation shown in FIGS. 33A to 33D; hence, only the difference between them will be described.

The condenser microphone of the second variation is characterized by providing a stopper layer 2160 having insulating properties fixed to each of the intermediate portions of the six second supports 2152, which support the back plate 2120 above the substrate 2130 in the gap 2140 formed between the diaphragm 2110 and the back plate 2120. The stopper layer 2160 is a thin film composed of polysilicon, which is not added with impurities, wherein it has a disk-like shape in which the thickness thereof is approximately 0.5 μm, and the radius thereof is approximately 30 μm. Incidentally, the distance between the stopper layer 2160 and the diaphragm 2110 is approximately 3 μm.

The manufacturing method of the condenser microphone of the second variation shown in FIG. 34 additionally introduces the following step in comparison with the manufacturing method of the condenser microphone of the first variation.

Similar to the manufacturing method of the first variation, after the formation of the diaphragm 2110, a polysilicon layer not added with impurities is formed above the diaphragm 2110 and the first insulating film via an additional insulating film (or an additional sacrifice film) composed of a silicon oxide film of approximately 3 μm thickness, wherein it is processed into a prescribed shape by way of etching, thus forming the stopper layer 2160.

Thereafter, a second conductive film is formed above the stopper layer 2160 and the additional insulating film via a second insulating film (or a second sacrifice film); then, the second conductive layer is processed into a prescribed shape by way of etching, thus forming the back plate 2120. Furthermore, a third insulating film is formed above the back plate 2120 and the second insulating film; then, the backside of the substrate 2130 is polished so that the substrate 2130 is selectively removed, thus forming an opening.

Thereafter, the third insulating film, the second insulating film, the additional insulating film, and the first insulating film are selectively removed by way of etching, thus forming the gap 2140 between the back plate 2120 and the diaphragm 2110. The cavity 2132 is formed in the substrate 2130; the passage 2134 having a desired acoustic resistance is formed; and the first support 2152 is formed between the diaphragm 2110 and the substrate 2130. At this time, a laminated insulating film, which is composed of the second insulating film between the back plate 2120 and the stopper layer 2160 as well as the additional insulating film and the first insulating film, which are intervened between the stopper layer 2160 and the substrate 2130, is intentionally left, thus forming the second supports 2152 in which the stopper layer 2160 is fixed to each of the intermediate portions thereof and which support the back plate 2120 above the substrate 2130.

As described above, it is possible to produce the condenser microphone of the second variation shown in FIGS. 34A to 34D.

The condenser microphone of the second variation shown in FIGS. 34A to 34D demonstrates an effect, in which, by arranging the stopper layer 2160 having insulating property in the gap 2140 between the diaphragm 2110 and the back plate 2120, it is possible to prevent the diaphragm 2110 and the back plate 2120 from coming in contact with each other even when excessive sound pressure is applied to the diaphragm 2110 and even when mechanical impact is applied from the exterior, in addition to the effect realized by the condenser microphone shown in FIGS. 32A to 32D. Thus, it is possible to further stabilize the operation of the condenser microphone.

The present invention is adapted to condenser microphones incorporated into electronic devices such as portable telephones, information terminals, and personal computers as well as audio devices.

The invention claimed is:

1. A condenser microphone comprising:

a diaphragm having a conductivity, which includes a center portion and a plurality of arms extended externally in a radial manner and which vibrates due to sound waves;

a back plate having a conductivity, which is positioned opposite to the diaphragm;

a substrate having a cavity that is positioned opposite to the back plate so as to face the diaphragm;

a first support for supporting the diaphragm above the substrate while insulating tip ends of the arms of the diaphragm from the substrate, thus forming a passage between the substrate and the diaphragm; and a second support, which is positioned between the arms of the diaphragm so as to support the back plate above the substrate while insulating an external periphery of the back plate from the substrate, thus forming a gap between the center portion of the diaphragm and the back plate, wherein the distance from the center of the back plate to an outer end thereof is shorter than the distance from the center of the center portion of the diaphragm to the distal end of the arm.

2. A condenser microphone according to claim 1, wherein the passage forms an acoustic resistance between the substrate surrounding the cavity and the diaphragm.

3. A condenser microphone according to claim 1, wherein an acoustic resistance is positioned between the arms of the diaphragm and is formed between the substrate and the diaphragm.

4. A condenser microphone according to claim 1, wherein a cutout is formed in the back plate to match each of positions opposite to the arms of the diaphragm.

5. A condenser microphone according to claim 1, wherein a projection projecting toward the substrate is formed in the diaphragm and is positioned at the arm of the diaphragm.

6. A condenser microphone according to claim 1, wherein a projection projecting toward the substrate is formed in the diaphragm and is positioned at a position between the arms of the diaphragm.

7. A condenser microphone according to claim 1, wherein the cavity has an opening formed along an inside of the center portion of the diaphragm.

8. A condenser microphone according to claim 1, wherein a plurality of holes are formed in the arms of the diaphragm.

9. A condenser microphone comprising:

a back plate having a conductivity, which includes a center portion and a plurality of arms extended externally in a radial manner;

a diaphragm having a conductivity, which is positioned opposite to the back plate so as to vibrate due to sound waves;

a substrate having a cavity that is positioned opposite to the back plate so as to face the diaphragm; and a support member for supporting the diaphragm above the substrate while insulating an external circumference of the diaphragm from tip ends of the arms of the back plate, thus forming a gap between the diaphragm and the center portion of the back plate.

10. A condenser microphone according to claim 9, wherein a cutout is formed in the diaphragm at a position opposite to the arm of the back plate.

11. A condenser microphone comprising:

a diaphragm having a conductivity, which includes a center portion and a plurality of arms extended externally in a radial manner so as to vibrate due to sound waves;

a back plate having a conductivity, which is positioned opposite to the diaphragm;

a substrate having a cavity that is positioned opposite to the back plate so as to face the diaphragm;

a spacer whose lower surface joins each of tip ends of the plurality of arms of the diaphragm;

a bridge whose inner end joins an upper surface of the spacer;

a first support having an insulating property, which supports an outer end of the bridge above the substrate; and a second support having an insulating property, which supports an external periphery of the back plate above the substrate, wherein a gap is formed between the center portion of the diaphragm and the back plate.

12. A condenser microphone according to claim 11, wherein the distance from the center of the back plate to the external periphery is shorter than the distance from the center of the center portion of the diaphragm to the distal end of the arm.

13. A condenser microphone according to claim 11, wherein a plurality of cutouts are formed in the back plate at positions opposite to the plurality of arms of the diaphragm.

14. A condenser microphone according to claim 11, wherein the second support is positioned between the plurality of arms of the diaphragm.

15. A condenser microphone according to claim 11, wherein the bridge is composed of the same material as the back plate and is formed simultaneously with formation of the back plate.

16. A condenser microphone according to claim 11, wherein a plurality of holes are formed in the bridge.

17. A condenser microphone according to claim 11, wherein the cavity has an opening that is formed along an inside of the external periphery of the diaphragm.

18. A condenser microphone comprising:

a diaphragm having a conductivity, which includes a center portion having a plurality of holes and a peripheral portion surrounding thereby so as to vibrate due to sound waves;

a back plate having a conductivity, which is positioned opposite to the diaphragm;

a substrate having a cavity that is positioned opposite to the back plate so as to face the diaphragm;

a first support having an insulating property, which is a support member for supporting the center portion of the diaphragm and the back plate with an air gap therebetween and which supports the peripheral portion of the diaphragm; and a plurality of second supports each having an insulating property, which are inserted into a plurality of holes formed in the center portion of the diaphragm respectively and which support the back plate above the substrate.

19. A condenser microphone according to claim 18, wherein the back plate is positioned opposite to the center portion of the diaphragm.

20. A condenser microphone according to claim 18, wherein a stopper layer having an insulating property is arranged in the gap between the diaphragm and the back plate.

21. A condenser microphone according to claim 20, wherein the stopper layer is fixed to the second support.

22. A condenser microphone according to claim 18, wherein a plurality of small holes are formed in a plurality of regions positioned opposite to the substrate in the peripheral portion of the diaphragm.

* * * * *